US010867572B2

(12) United States Patent
Itoman et al.

(10) Patent No.: US 10,867,572 B2
(45) Date of Patent: Dec. 15, 2020

(54) IMAGE DISPLAY DEVICE AND DISPLAY METHOD FOR IMAGE DISPLAY DEVICE

(71) Applicant: Panasonic Liquid Crystal Display Co., Ltd., Himeji (JP)

(72) Inventors: Tatsuo Itoman, Osaka (JP); Satoshi Hirotsune, Hyogo (JP)

(73) Assignee: PANASONIC LIQUID CRYSTAL DISPLAY CO., LTD., Hyogo (JP)

( * ) Notice: Subject to any disclaimer, the term of this patent is extended or adjusted under 35 U.S.C. 154(b) by 0 days.

(21) Appl. No.: 16/687,964

(22) Filed: Nov. 19, 2019

(65) Prior Publication Data

US 2020/0286440 A1 Sep. 10, 2020

(30) Foreign Application Priority Data

Mar. 4, 2019 (JP) ..... 2019-038916

(51) Int. Cl.
*G09G 3/36* (2006.01)

(52) U.S. Cl.
CPC ..... *G09G 3/3688* (2013.01); *G09G 3/3614* (2013.01); *G09G 3/3696* (2013.01); *G09G 2300/0842* (2013.01)

(58) Field of Classification Search
CPC .. G09G 3/3688; G09G 3/3614; G09G 3/3696; G09G 2300/0842
See application file for complete search history.

(56) References Cited

U.S. PATENT DOCUMENTS

2005/0146490 A1* 7/2005 Kang ..... G09G 3/3614 345/76
2007/0152942 A1* 7/2007 Yamagishi ..... G09G 3/3614 345/96

FOREIGN PATENT DOCUMENTS

JP 2003-280578 10/2003

* cited by examiner

*Primary Examiner* — Abhishek Sarma

(74) *Attorney, Agent, or Firm* — Hamre, Schumann, Mueller & Larson, P.C.

(57) ABSTRACT

An image display device includes: a display; gate signal lines including a first pixel row and a second pixel row; a gate driver; data signal lines; a source driver; and a controller that determines whether the second pixel row has correlation with the first pixel row in an image. When determining that the second pixel row has the correlation with the first pixel row, the controller causes the source driver to supply the data voltage corresponding to the first pixel row, causes the gate driver to supply the gate signal to write the data voltage in the first pixel row, and causes the gate driver to supply the gate signal to write the data voltage corresponding to the first pixel row in the second pixel row.

13 Claims, 15 Drawing Sheets

IMAGE DISPLAY DEVICE AND DISPLAY METHOD FOR IMAGE DISPLAY DEVICE

CROSS-REFERENCE TO RELATED APPLICATION

This application claims priority from Japanese application JP 2019-038916, filed on Mar. 4, 2019. This Japanese application is incorporated herein by reference.

TECHNICAL FIELD

The present disclosure relates to an image display device and a display method for the image display device.

BACKGROUND

In a liquid crystal display device, for example, based on an image signal input from an outside, frame images displayed on a liquid crystal display are sequentially switched to display a smooth image on the liquid crystal display. Generally, 60 Hz is used as a frame frequency that is a frequency at which a frame image is switched.

Reduction of power consumption by decreasing frame frequency has been studied in liquid crystal display devices. For example, Unexamined Japanese Patent Publication No. 2003-280578 discloses a display device that detects whether the input image signal is a signal representing a still image or a moving image, and reduces the power consumption during image display by decreasing frame frequency when the input image signal is the signal representing the still image.

SUMMARY

However, in the display device disclosed in Unexamined Japanese Patent Publication No. 2003-280578, image quality degradation is generated due to the decrease in frame frequency.

The present disclosure provides an image display device that can reduce the power consumed in a display panel while preventing the generation of the image quality degradation, and a display method for the image display device.

An image display device according to a first present disclosure has a display region configured by arranging a plurality of pixels in a matrix form. The image display device includes: a display region configured by arranging a plurality of pixels in a matrix form; a plurality of gate signal lines respectively disposed for each pixel row including a first pixel row and a second pixel row different from each other in the display, and the plurality of gate signal lines being used to select a pixel row in which a data voltage corresponding to image data is written; a gate driver that supplies a gate signal to the plurality of gate signal lines; a plurality of data signal lines respectively disposed for each pixel column in the display, the plurality of data signal lines being used to write the data voltage in pixels of the selected pixel row; and a source driver that supplies the data voltage to the plurality of data signal lines; and a controller that determines whether the second pixel row has correlation with the first pixel row in an image, and controls the gate driver and the source driver based on a determined result. When determining that the second pixel row has the correlation with the first pixel row, the controller causes the source driver to supply the data voltage corresponding to the first pixel row, causes the gate driver to supply the gate signal to write the data voltage in the first pixel row, and causes the gate driver to supply the gate signal to write the data voltage corresponding to the first pixel row in the second pixel row.

An image display device according to a second present disclosure has a display region configured by arranging a plurality of pixels in a matrix form. The image display device includes: a plurality of gate signal lines respectively disposed for each pixel row in the display, and the plurality of gate signal lines being used to select a pixel row in which a data voltage corresponding to image data is written; a gate driver that supplies a gate signal to the plurality of gate signal lines; a plurality of data signal lines respectively disposed for each pixel column in the display, the plurality of data signal lines being used to write the data voltage in pixels of the selected pixel row; a source driver that supplies the data voltage to the plurality of data signal lines; and a controller that controls the gate driver and the source driver. The controller includes a phase inversion controller that inverts a phase of polarity of the data voltage in units of m (m is an integer of 1 or more) pixel rows, and sets a position of the pixel row where the phase of the polarity of the data voltage is inverted by each predetermined pixel row in each frame.

A display method of an image display device according to a third present disclosure is provided. The image display device includes a display region configured by arranging a plurality of pixels in a matrix form. The display method includes: determining whether a second pixel row has correlation with a first pixel row in an image in the first pixel row and the second pixel row that are different from each other in the display; and causing a source driver to supply a data voltage corresponding to the first pixel row, causing gate driver to supply a gate signal to write the data voltage in the first pixel row, and causing the gate driver to supply the gate signal to write the data voltage corresponding to the first pixel row in the second pixel row when determining that the second pixel row has the correlation with the first pixel row.

A display method of an image display device according to a fourth present disclosure is provided. The image display device includes a display region configured by arranging a plurality of pixels in a matrix form. The display method includes: inverting a phase of polarity of a data voltage in units of m (m is an integer of 1 or more) pixel rows; and shifting a position of a pixel row where the phase of the polarity of the data voltage is inverted by every predetermined pixel rows in each frame.

DETAILED DESCRIPTION (Knowledge Forming Basis of the Present Disclosure)

Figure 15:
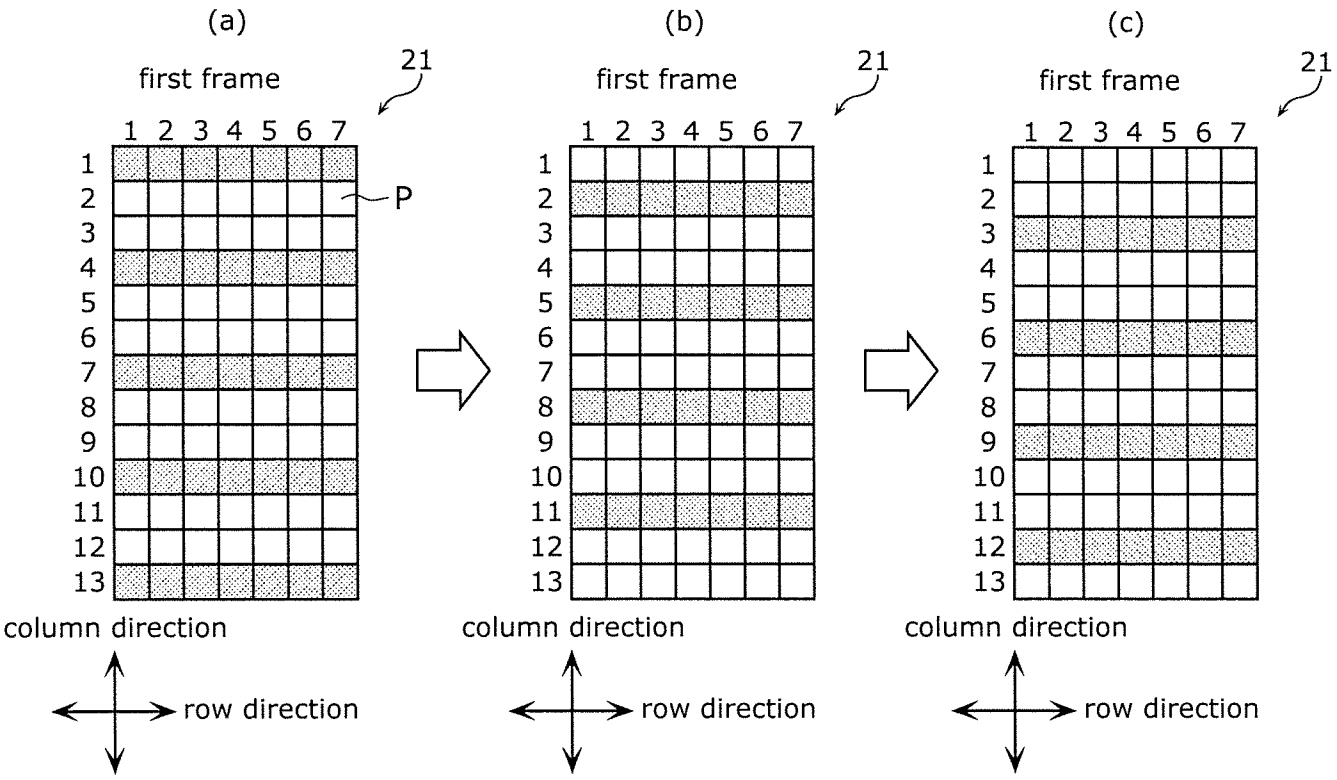
FIG. 15 is a view illustrating a display example of a liquid crystal panel according to a comparative example.

Reduction of power consumption has been studied in driving a liquid crystal panel of a liquid crystal display device. For example, it has been studied to reduce the power consumption of the display panel by decreasing frame frequency for driving the display panel. FIG. 15 is a view illustrating a display example of a liquid crystal panel according to a comparative example. Specifically, image display region 21 of the liquid crystal panel is illustrated in FIG. 15. Image display region 21 includes a plurality of pixels P arranged in a matrix form. Numerical values arranged in a vertical direction on the paper surface in FIG. 15 are numerical values for identifying pixel rows, and numerical values arranged in a horizontal direction on the paper surface are numerical values for identifying pixel columns. A pixel row with a hatched dot in FIG. 15 indicates a writing line.

For example, FIG. 15 illustrates an example in which processing of writing a data voltage is performed every three pixel rows (three lines) at 60-Hz drive in order to suppress the power consumption of the liquid crystal panel driven at 60 Hz to the power consumption equivalent to 20-Hz drive. As illustrated in a part (a) of FIG. 15, for example, in a first frame, the writing processing is performed only on the pixel rows 1, 4, 7, 10, and 13 among the pixel rows 1 to 13. As illustrated in a part (b) of FIG. 15, in a second frame, the writing processing is performed only on the pixel rows 2, 5, 8, and 11 different from the pixel rows 1, 4, 7, 10, and 13 subjected to the writing processing in the first frame among the pixel rows 1 to 13. Then, as illustrated in a part (c) of FIG. 15, in a third frame, the writing processing is performed only on the pixel rows 3, 6, 9, and 12 different from the pixel rows 1, 2, 4, 5, 7, 8, 10, 11, and 13 subjected to the writing processing in the first frame and the second frame among the pixel rows 1 to 13. Consequently, the liquid crystal panel is driven at 60 Hz, but the drive frequency for each pixel row is 20 Hz, so that the power consumption can be reduced.

The example in which the writing processing is performed every three lines in each frame is described above, but the present disclosure is not limited to the example. For example, when the writing processing is performed every N (N is an integer of 1 or more) line in each frame, the drive frequency for each pixel row becomes 60/N, and the power consumption can be reduced. In this way, the power consumption can be reduced by performing thinning-out drive (an example of the low power drive).

However, in driving the liquid crystal panel, image quality degradation is generated by a voltage drop due to a charge loss such as leakage of data (gradation) voltage in pixel capacitance (liquid crystal capacitance). Specifically, a change in hue, generation of ghosting or flicker can be cited. In the above method, because of a long interval for performing the writing processing on the pixel row, there is a risk of generating the image quality degradation due to the charge loss such as the leakage. That is, coexistence of prevention of the image quality deterioration and the reduction of the power consumption can hardly be achieved in the liquid crystal display device of the comparative example.

For this reason, the inventor of the present disclosure intensively studied a liquid crystal display device capable of achieving the coexistence of the prevention of the image quality degradation and the reduction of the power consumption in the liquid crystal panel. As a result, the inventor created the following liquid crystal display device.

Hereinafter, exemplary embodiments will specifically be described with reference to the drawings. The following exemplary embodiments provide comprehensive or specific examples of the present disclosure. Numerical values, shapes, materials, components, arrangement positions and connection modes of the components, steps, and order of the steps, for example, illustrated in the following exemplary embodiments are examples, and therefore are not intended to limit the present disclosure. Among the components in the following exemplary embodiments, the components that are not recited in the independent claims are described as an optional component.

The drawings are schematic diagrams, and not necessarily strictly illustrated. In the drawings, substantially the same configuration is designated by the same reference numerals, and overlapping description will be omitted or simplified.

In the specification, terms indicating a relationship between elements such as the same, numerical values, and numerical ranges are not an expression expressing only a strict meaning, but are a meaning including a substantially equivalent range, for example, a difference of about several percent.

First Exemplary Embodiment

A liquid crystal display device according to a first exemplary embodiment will be described below with reference to FIGS. 1 to 5.

[1-1. Configuration of Liquid Crystal Display Device]

Figure 1:
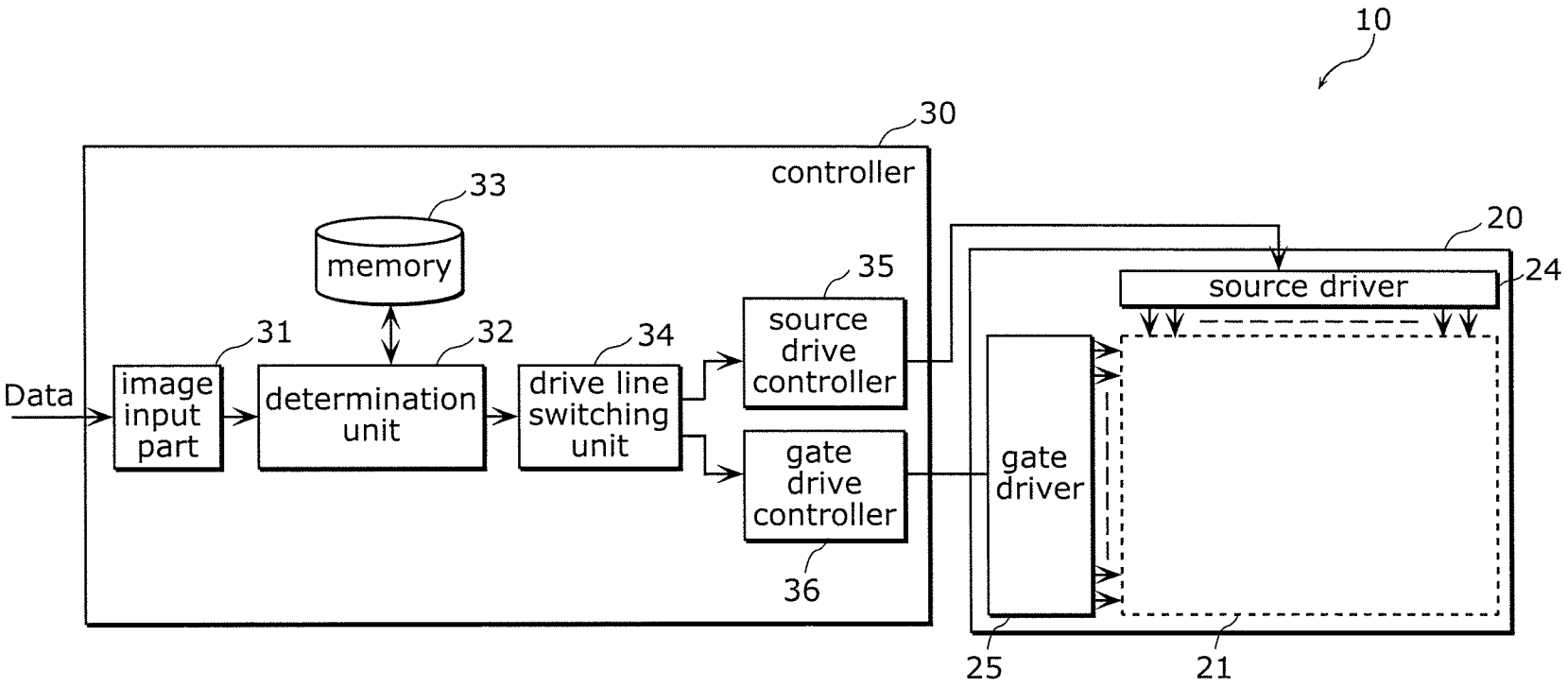
FIG. 1 is a block diagram illustrating a functional configuration of a liquid crystal display device according to a first exemplary embodiment.
Figure 2:
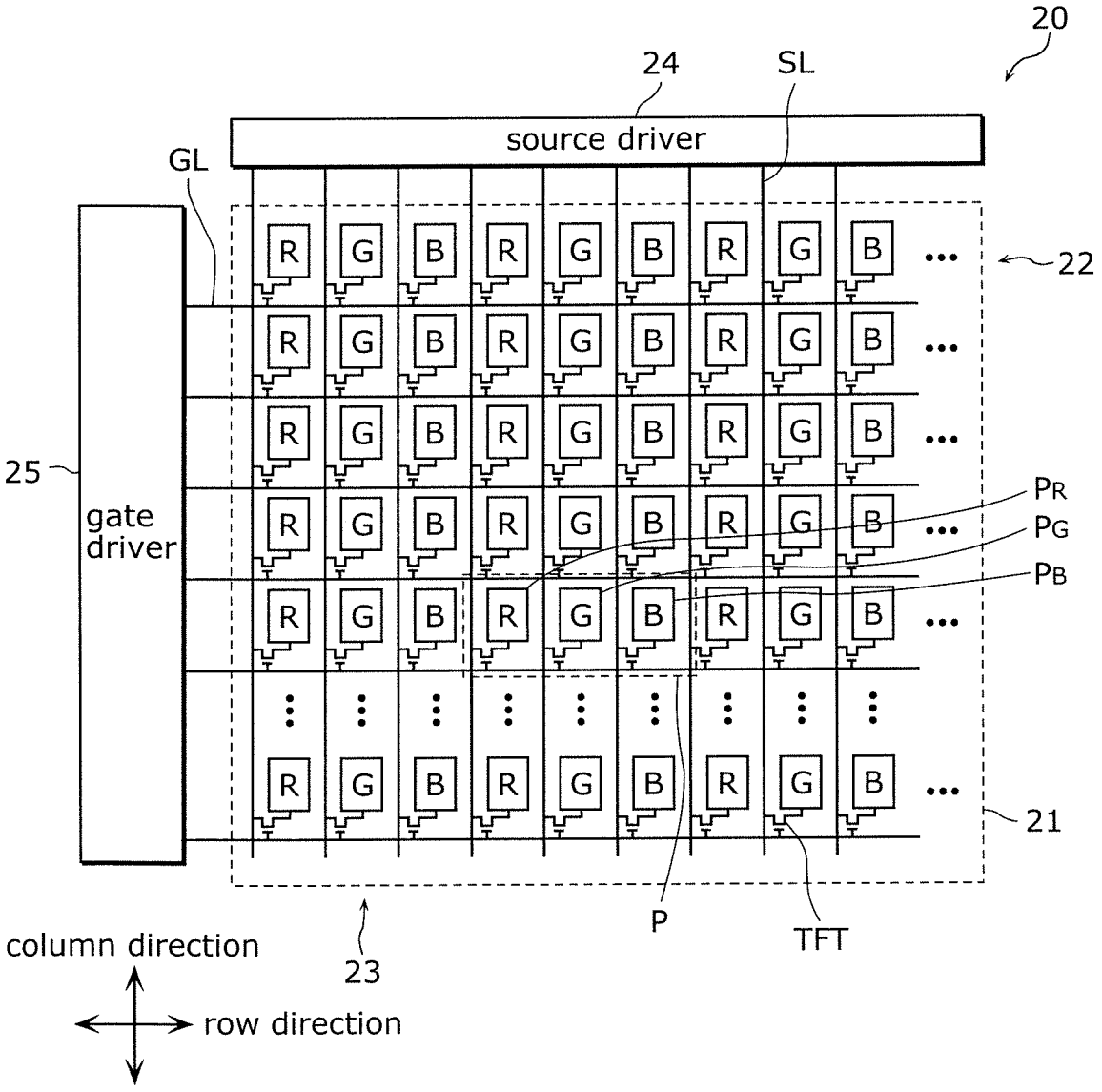
FIG. 2 is a view illustrating a schematic configuration of a liquid crystal panel in the liquid crystal display device of the first exemplary embodiment.

A schematic configuration of liquid crystal display device 10 of the first exemplary embodiment will be described with reference to FIGS. 1 and 2. FIG. 1 is a block diagram illustrating a functional configuration of liquid crystal display device 10 of the first exemplary embodiment. FIG. 2 is a view illustrating a schematic configuration of liquid crystal panel 20 in liquid crystal display device 10 of the first exemplary embodiment.

As illustrated in FIG. 1, liquid crystal display device 10 includes liquid crystal panel 20 and controller 30. Liquid crystal display device 10 includes components such as a backlight (not illustrated). Liquid crystal display device 10 is an example of the image display device. Liquid crystal panel 20 is an example of the display panel included in the image display device.

Liquid crystal panel 20 displays an image (for example, a color image) visually recognized by a user based on a control signal from controller 30. A liquid crystal drive system of liquid crystal panel 20 may be an IPS (In Plane Switching) system, a VA (Vertical Alignment) system, or other drive systems. For example, liquid crystal panel 20 is normally black, displays white during voltage application, and displays black during no voltage application. However, liquid crystal panel 20 may be normally white.

Source driver 24 and gate driver 25 are provided in liquid crystal panel 20 in order to display an image corresponding to an input video signal on image display region 21.

Specifically, liquid crystal panel 20 is connected to a plurality of flexible wiring boards (not illustrated) on which source driver 24 is mounted. A plurality of gate drivers 25 are mounted on liquid crystal panel 20.

As illustrated in FIG. 2, liquid crystal panel 20 including image display region 21 includes a plurality of data signal lines SL, a plurality of gate signal lines GL, and a plurality of thin film transistors TFT.

Image display region 21 is constructed with a plurality of pixels P arranged in a matrix form. One pixel P is constructed with a plurality of subpixels each of which serves as a display unit region. In the first exemplary embodiment, one pixel P is constructed with three subpixels of a red subpixel PR, a green subpixel PG, and a blue subpixel PB arranged in a row direction. A pixel electrode and a common electrode (not illustrated) are formed for each pixel P. In each pixel P, pixel capacitance (liquid crystal capacitance) is generated by the pixel electrode and the common electrode.

The plurality of data signal lines SL are provided for each pixel column 23 in image display region 21, and are provided to write a data voltage in the pixels in selected pixel row 22. The plurality of data signal lines SL extend in a column direction (vertical direction), and are arranged in the row direction (horizontal direction).

The plurality of gate signal lines GL are provided for each pixel row 22 in image display region 21, and provided to select the pixel row in which the data voltage corresponding to image data is written. The plurality of gate signal lines GL extend in the row direction (horizontal direction), and are arranged in the column direction (vertical direction).

The plurality of thin film transistors TFT and pluralities of red subpixels PR, green subpixels PG, and blue subpixels PB are arranged in a matrix form at intersections of the plurality of data signal lines SL and the plurality of gate signal lines GL. The data voltage (data signal) is supplied from source driver 24 to each data signal line SL, and a gate voltage (gate signal) is supplied from gate driver 25 to each gate signal line GL. A common voltage is supplied from a common power source (not illustrated) to the common electrode. When the gate voltage is supplied to gate signal line GL, thin film transistor TFT connected to gate signal line GL is turned on, and the data voltage is supplied to the pixel electrode through data signal line SL connected to thin film transistor TFT.

Pixel row 22 is constructed with the plurality of pixels P arranged in the row direction. Pixel column 23 is constructed with the plurality of pixels P arranged in the column direction. The plurality of pixel rows 22 include a writing line (an example of the first pixel row) and a non-writing line (an example of the second pixel row) (to be described later).

Source driver 24 supplies the data voltage corresponding to the image data to data signal line SL based on the image data and various control signals (for example, a data start pulse signal, a data clock signal, a latch timing signal, and a polarity control signal) acquired from controller 30. The data voltage charges the pixel capacitance. The latch timing signal is a signal for controlling operation timing of source driver 24, and the polarity control signal (POL) is a signal for controlling polarity of the data voltage.

Source driver 24 operates a shift register (not illustrated) and a sampling latch circuit (not illustrated) of source driver 24 according to the various control signals, and converts the image data into an analog signal using a DA converter circuit (not illustrated), thereby generating the data voltage. Source driver 24 includes an amplifier (not illustrated) that amplifies the positive-polarity data voltage and an amplifier (not illustrated) that amplifies the negative-polarity data voltage, and the data voltage is amplified by the amplifier selected according to the polarity, and supplied to data signal line SL.

Gate driver 25 supplies the gate signal to gate signal line GL based on various timing signals (for example, a gate start pulse signal and a gate clock signal) acquired from controller 30. Gate driver 25 generates the gate signal by operating a shift register (not illustrated) of gate driver 25 according to the gate clock signal and the gate start pulse signal. That is, gate driver 25 starts output of the gate signal to gate signal line GL in synchronization with the gate start pulse signal. Gate driver 25 sequentially supplies the gate signal to one side in the column direction (for example, from a top to a bottom) of the plurality of pixel rows 22. Gate driver 25 switches gate signal line GL that outputs the gate signal each time the gate clock signal is input.

Referring to FIG. 1, controller 30 receives input image signal Data transmitted from an external system (not illustrated), and outputs the image data and various timing signals in order to control source driver 24 and gate driver 25 based on received input image signal Data. Similarly to the liquid crystal display device of the comparative example, controller 30 performs the writing processing (thinning-out drive) for every N line (N is an integer of 1 or more) in each frame. That is, controller 30 writes the data voltage for each predetermined pixel row in the plurality of pixel rows 22 in one frame in the plurality of frames, and gate driver 25 and source driver 24 control presence or absence of the writing of the data voltage in each of the plurality of pixel rows 22 in the plurality of frames. The first exemplary embodiment is characterized in that the data voltage is also supplied to pixel row 22 (non-writing line) in which the writing should not be performed in the frame when controller 30 satisfies a predetermined condition. Specifically, the first exemplary embodiment is characterized in that controller 30 determines whether a correlation exists between the images of the non-writing line and the writing line, and controls gate driver 25 and source driver 24 based on a determined result.

Controller 30 includes image input unit 31, determination unit 32, memory 33, drive line switching unit 34, source drive controller 35, and gate drive controller 36. For example, controller 30 may control the drive of the backlight.

Image input unit 31 receives input image signal Data from the external system, performs predetermined image processing, and outputs the image data to determination unit 32. Image input unit 31 also receives signals such as a horizontal synchronizing signal and a vertical synchronizing signal corresponding to input image signal Data.

Determination unit 32 stores the image data output from image input unit 31 in memory 33. In one frame, determination unit 32 compares the image of the pixel row in which the writing is performed (an example of the first pixel row, hereinafter also referred to as the writing line) to the image of the pixel row in which the writing should not be performed (an example of the second pixel row, hereinafter also referred to as the non-writing line), and determines whether the non-writing line has the correlation with the writing line based on the comparison result. For example, determination unit 32 determines whether the correlation in the image exists in units of pixels P, and determines whether the correlation exists based on the determination result for each pixel P. Determination unit 32 may store the result of the determination whether the correlation exists in memory 33. Hereinafter, "the correlation in the image" is also simply referred to as "correlation".

Memory 33 is a storage device that stores the image data of pixel row 22 of which determination unit 32 compares the correlation. Memory 33 has a storage capacity for storing the image data for pixel row 22 used for the determination by determination unit 32. Memory 33 has the storage capacity capable of storing the image data for at least two pixel rows 22. For example, when source driver 24 performs the writing every N lines, memory 33 has the storage capacity for storing the image data for at least 2N lines.

Drive line switching unit 34 outputs control signals such as the image data and the synchronizing signal to source drive controller 35 and gate drive controller 36 based on the image data output from determination unit 32 and the determination result of the correlation.

Source drive controller 35 generates the image data and various control signals (for example, the data start pulse signal, the data clock signal, the latch timing signal, and the polarity control signal) for controlling the drive of source driver 24 based on the image data output from drive line switching unit 34 and the control signal (for example, the horizontal synchronizing signal), and outputs the image data and the various control signals to source driver 24.

Source drive controller 35 controls source driver 24 such that source driver 24 performs column inversion drive (column inversion drive) in which the polarities of the data voltages supplied to two adjacent data signal lines SL are different from each other. In the first exemplary embodiment, by way of example, source drive controller 35 controls source driver 24 such that source driver 24 performs the column inversion drive while performing frame inversion driving. However, the drive system is not limited to the first exemplary embodiment.

Gate drive controller 36 generates various timing signals (for example, the gate start pulse signal and the gate clock signal) controlling the drive of gate driver 25 based on various control signals (for example, the horizontal synchronizing signal and the vertical synchronizing signal) output from drive line switching unit 34, and outputs the various timing signals to gate driver 25.

[1-2. Operation of Liquid Crystal Display Device]

Figure 3:
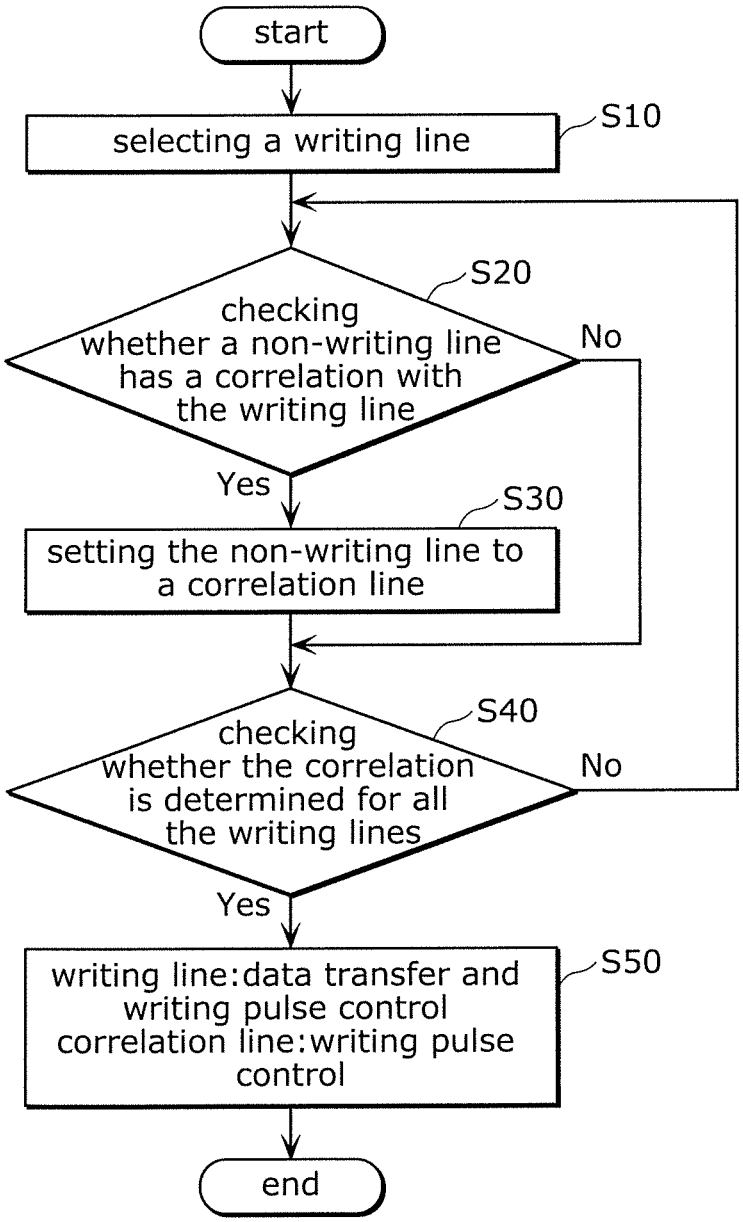
FIG. 3 is a flowchart illustrating operation of the liquid crystal display device of the first exemplary embodiment.
Figure 4:
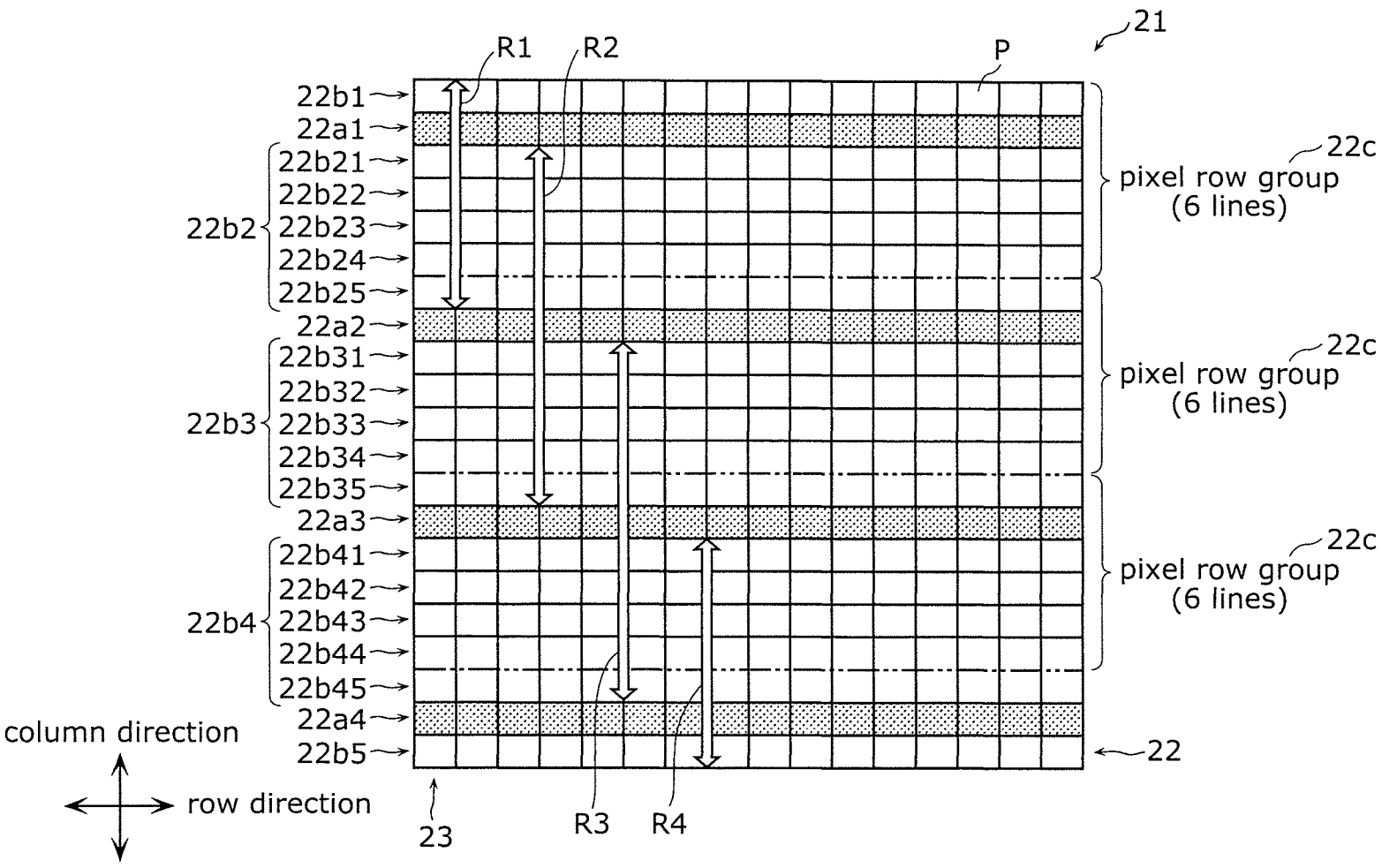
FIG. 4 is a view illustrating a range in which a correlation is compared in the liquid crystal display device of the first exemplary embodiment.

Operation of liquid crystal display device 10 will be described below with reference to FIGS. 3 and 4. FIG. 3 is a flowchart illustrating the operation of liquid crystal display device 10 of the first exemplary embodiment. FIG. 4 is a view illustrating a range in which a correlation is compared in liquid crystal display device 10 of the first exemplary embodiment. Pixel row 22 with the hatched dot in FIG. 4 indicates the writing line, and the pixel row 22 without the hatched dot indicates the non-writing line.

As illustrated in FIG. 3, controller 30 selects the writing line (S10). Specifically, controller 30 decides the pixel row (that is, the writing line) in which the data voltage is written in the first frame. For example, controller 30 decides the writing line such that the data voltage is written in the pixel row 22 of every N lines in the plurality of pixel rows.

FIG. 4 illustrates an example in which the data voltage is written every six lines (N=6). FIG. 4 also illustrates an example in which pixel rows 22*a*1, 22*a*2, 22*a*3, and 22*a*4 are selected as the writing line in the plurality of pixel rows 22. For example, one writing line is selected for one pixel row group 22*c*. The writing line selected from pixel row group 22*c* varies in each frame. From the viewpoint of preventing flickering, the writing line may be selected at random regardless of arrangement order of the pixel rows. When controller 30 inverts the polarity of the data voltage for each frame in the frame inversion drive, a number of pixel rows 22 constituting pixel row group 22*c* may be an odd number in order to prevent the data voltage having the same polarity from being supplied to one pixel row 22.

Subsequently, controller 30 determines whether the non-writing line has the correlation with the writing line (S20). For example, determination unit 32 may determine whether the non-writing line has the correlation with the writing line based on a number of pixels (or a number of subpixels) having the correlation with the writing line in the plurality of pixels constituting the non-writing line. For example, determination unit 32 may determine whether, in at least one first pixel constituting the writing line and at least one second pixel constituting the non-writing line, a difference in pixel value (gradation value) between the first pixel and the second pixel disposed in identical pixel column 23 falls within a predetermined value, and determine that the non-writing line has the correlation with the writing line when the number of second pixels in which the difference in pixel value falls within the predetermined value is greater than or equal to a predetermined number.

Instead of the above determination, for example, determination unit 32 may determine whether the non-writing line has the correlation with the writing line based on a score indicating a degree of correlation between the non-writing line and the writing line. For example, determination unit 32 may calculate, in at least one first pixel constituting the writing line and at least one second pixel constituting the non-writing line, the score according to the difference in pixel value for each first pixel and second pixel disposed in identical pixel column 23, and determine that the non-writing line has the correlation with the writing line when a correlation value indicating the degree of correlation between the non-writing line and the writing line is greater than or equal to a predetermined value based on a total value of the calculated scores.

For example, determination unit 32 may decide an individual score (an example of the score) indicating the degree of correlation based on the difference in pixel values between the pixels located in identical pixel column 23 of the writing line and the non-writing line, and compare the correlation value calculated based on the individual score for each second pixel to a predetermined value to determine whether the non-writing line has the correlation with the writing line. For example, determination unit 32 may determine that the non-writing line has the correlation with the writing line when the correlation value is greater than or equal to the predetermined value in the case where the individual score is set larger with decreasing difference in pixel value. The correlation value is decided by statistically processing the individual score of each pixel P. For example, the correlation value is the total value of the individual scores, but may be a maximum value, a minimum value, an average value, or a median. Determination unit 32 may make a determination by combining a plurality of conditions such as a total value, a maximum value, a minimum value, an average value, and a median.

A range where determination unit 32 compares the correlation with the writing line will be described with reference to FIG. 4. In the first exemplary embodiment, because source driver 24 displays the image by column inversion drive, FIG. 4 illustrates the range where the correlation is compared in the case of performing the column inversion drive.

As illustrated in FIG. 4, determination unit 32 determines whether each of pixel rows 22*b*1 and 22*b*21 to 22*b*25 (hereinafter also referred to as non-writing lines 22*b*1 and 22*b*21 to 22*b*25) located in range R1 has the correlation with pixel row 22*a*1 (hereinafter also referred to as writing line 22*a*1). Determination unit 32 determines whether each of pixel rows 22*b*21 to 22*b*25 and 22*b*31 to 22*b*35 located in range R2 has the correlation with pixel row 22*a*2 (hereinafter also referred to as writing line 22*a*2). Similarly, determination unit 32 determines whether each of pixel rows 22*b*31 to 22*b*35 and 22*b*41 to 22*b*45 located in range R3 has the correlation with the pixel row 22*a*3 (hereinafter also referred to as writing line 22*a*3), and determines whether each of pixel rows 22*b*41 to 22*b*45 and 22*b*5 located in range R4 has the correlation with pixel row 22*a*4. Non-writing line group 22*b*2 is located between writing lines 22*a*1 and 22*a*2, and constructed with non-writing lines 22*b*21 to 22*b*25 in the example of FIG. 4. Non-writing line group 22*b*3 is located between pixel rows 22*a*2 and 22*a*3, and constructed with pixel rows 22*b*31 to 22*b*35 in the example of FIG. 4. Non-writing line group 22*b*4 is located between pixel rows 22*a*3 and 22*a*4, and constructed with pixel rows 22*b*41 to 22*b*45 in the example of FIG. 4.

As described above, the plurality of writing lines exist in one frame, and determination unit 32 determines whether the writing line (for example, writing line 22*a*2) located at the center in the column direction among three writing lines (for example, writing lines 22*a*1 to 22*a*3) arranged side by side has the correlation with each of at least two non-writing lines (for example, pixel row 22 constituting non-writing line groups 22*b*2 and 22*b*3 disposed between the writing line and the rest two writing lines (for example, writing lines 22*a*1 and 22*a*3) except for the writing line. Determination unit 32 determines whether each of the non-writing lines (for example, pixel rows 22 constituting non-writing line groups 22*b*2 and 22*b*3) located up to writing lines 22*a*1 and 22*a*3 vertically located in the column direction with respect to writing line 22*a*2 has the correlation with writing line 22*a*2.

As illustrated in FIG. 4, for example, non-writing line group 22*b*2 is located in both ranges R1 and R2. That is, whether each of non-writing lines 22*b*21 to 22*b*25 constituting non-writing line group 22*b*2 has the correlation with each of writing lines 22*a*1 and 22*a*2 is determined. An example in which the determination that non-writing line 22*b*23 constituting non-writing line group 22*b*2 has the correlation with both writing lines 22*a*1 and 22*a*2 is made will be described below.

When determining that non-writing line 22*b*23 has the correlation with both writing lines 22*a*1 and 22*a*2, determination unit 32 further performs processing of narrowing writing lines 22*a*1 and 22*a*2 having the correlation with non-writing line 22*b*23 to one. That is, determination unit 32 associates one writing line with non-writing line 22*b*23.

Determination unit 32 narrows writing lines 22*a*1 and 22*a*2 with which non-writing line 22*b*23 has the correlation to one based on the determination result of the correlation between non-writing line 22*b*23 and writing lines 22*a*1 and 22*a*2. Determination unit 32 determines that the writing line having the higher correlation with non-writing line 22*b*23 is the writing line with which non-writing line 22*b*23 has the correlation. For example, determination unit 32 may compare a sum of pixels having the correlation between non-writing line 22*b*23 and writing line 22*a*1 to a sum of pixels having the correlation between non-writing line 22*b*23 and writing line 22*a*2, and determine that the writing line and non-writing line 22*b*23 having the larger sum of pixels having the correlation have the correlation.

The case where a plurality of non-writing lines determined to have the correlation with both writing lines 22*a*1 and 22*a*2 exist will be described below. In this case, when determining that the plurality of non-writing lines have the correlation with both writing lines 22*a*1 and 22*a*2, determination unit 32 further performs processing of narrowing writing lines 22*a*1 and 22*a*2 having the correlation with the plurality of non-writing lines to one. That is, determination unit 32 associates one writing line with the plurality of non-writing lines. An example in which non-writing lines 22*b*23 and 22*b*25 are determined to have the correlation with both writing lines 22*a*1 and 22*a*2 will be described below.

Determination unit 32 narrows the writing lines with which non-writing lines 22*b*23 and 22*b*25 have the correlation to one based on the determination result of the correlation between each of non-writing lines 22*b*23 and 22*b*25 and each of writing lines 22*a*1 and 22*a*2. Determination unit 32 determines that the writing line having the higher correlation with non-writing lines 22*b*23 and 22*b*25 is the writing line with which non-writing lines 22*b*23 and 22*b*25 have the correlation. For example, determination unit 32 may compare a total number of the sum of pixels having the correlation between non-writing line 22*b*23 and writing line 22*a*1 and the sum of pixels having the correlation between non-writing line 22*b*25 and writing line 22*a*2 to a total number of the sum of pixels having the correlation between non-writing line 22*b*23 and writing line 22*a*2 and the sum of pixels having the correlation between non-writing line 22*b*25 and writing line 22*a*1, and determine that the writing line and non-writing lines 22*b*23 and 22*b*25 having the larger total number of pixels have the correlation.

The correlation determination method performed by determination unit 32 is not limited to the above. Determination unit 32 may make the above determination based on at least one of the correlation value and the sum of correlated lines. Determination unit 32 calculates the total of correlation values of the non-writing lines included in non-writing line group 22*b*2 with respect to writing lines 22*a*1 and the sum of correlated non-writing lines. Determination unit 32 also calculates the total of the correlation values of the non-writing lines included in non-writing line group 22*b*2 with respect to writing line 22*a*2 and the sum of correlated non-writing lines. Determination unit 32 compares the sums of correlated non-writing lines or the totals of correlation values, and determines whether non-writing line group 22*b*2 has the stronger correlation with writing line 22*a*1 or 22*a*2. Determination unit 32 determines that the writing line and non-writing line group 22*b*2 have the stronger correlation when having the larger sum of correlated non-writing lines or the higher total of correlation value. When the sums of correlated non-writing lines are equal to each other, determination unit 32 may further determine whether non-writing line group 22*b*2 has the stronger correlation with writing line 22*a*1 or 22*a*2 based on the total of correlation values. When the sums of the correlation values are equal to each other, determination unit 32 may further determine whether non-writing line group 22*b*2 has the stronger correlation with writing line 22*a*1 or 22*a*2 based on the sum of correlated non-writing lines. Consequently, whether non-writing line group 22*b*2 sandwiched between writing lines 22*a*1 and 22*a*2 has the stronger correlation with writing line 22*a*1 or 22*a*2 can be determined.

As will be described below, determination unit 32 performs different processing for the writing line having the stronger correlation and the writing line having the weaker correlation. In the following description, it is assumed that the writing line having the stronger correlation with non-writing line group 22*b*2 is one of the writing lines, and that the writing line having the weaker correlation is the other writing line.

Specifically, determination unit 32 specifies the non-writing line located on the side of the most other writing line in the non-writing lines having the correlation with one of the writing lines in the plurality of non-writing lines included in non-writing line group 22*b*2. Then, the non-writing line located between the non-writing line located on the side of the most other writing line and one of the writing lines is determined to have the correlation with one of the writing lines. Subsequently, determination unit 32 determines whether the non-writing line that is not determined to have the correlation with one of the writing lines in the plurality of non-writing lines included in non-writing line group 22*b*2 has the correlation with the other writing line.

When both the totals of correlated non-writing lines are equal to each other and the sums of correlation values are equal to each other, non-writing line group 22*b*2 may be determined to have the correlation with either writing line 22*a*1 or 22*a*2.

In this case, determination unit 32 may determine that non-writing line 22*b*24 sandwiched between non-writing lines 22*b*23 and 22*b*25 has the correlation with the writing line with which non-writing lines 22*b*23 and 22*b*25 have the correlation.

Determination unit 32 stores the determination result of the correlation for each of the writing lines in memory 33, which allows determination unit 32 to determine whether the non-writing line has the correlation with both the two writing lines and which writing line has the higher correlation with the non-writing line.

Subsequently, determination unit 32 sets the non-writing line determined to have the correlation with the writing line by the above determination (Yes in S20) to a correlation line (S30). Although details will be described later, the correlation line means the pixel row in which the same data voltage as the writing line is written.

When determination unit 32 determines that the non-writing line does not have the correlation with the writing line (No in S20), the processing proceeds to step S40.

Subsequently, determination unit 32 determines whether the correlation is determined for all the writing lines (S40). The processing proceeds to step S50 when determination unit 32 determines that the determination of the correlation is made for all the writing lines (Yes in S40). When determination unit 32 determines that the determination of the correlation is not made for all the writing lines (No in S40), the processing proceeds to step S20, and the pieces of processing in steps S20 to S40 are repeatedly performed until the determination of the correlation is made for all the writing lines.

Subsequently, controller 30 performs data transfer and writing pulse control on the writing line, and performs the writing pulse control in the data transfer and the writing pulse control on the correlation line (S50). Controller 30 controls source driver 24 and gate driver 25 so as to supply the data voltage to the writing line earlier than the correlation line. In other words, after the data voltage is supplied to the writing line, the data voltage is supplied to the correlation line.

Drive line switching unit 34 switches the pixel row in which the data voltage is written for each frame based on the determination result of determination unit 32. Drive line switching unit 34 decides that the writing line in the frame and the correlation line having the correlation with the writing line are the pixel rows in which the data voltage is written in the frame. For example, it is assumed that drive line switching unit 34 decides that writing lines 22*a*1 to 22*a*4 and non-writing line 22*b*23 are the pixel rows in which the data voltage is written. Drive line switching unit 34 outputs a signal including the decided result to source drive controller 35 and gate drive controller 36.

Details of the operation in step S50 will be described below. The operation for the writing line will be described first.

Source drive controller 35 performs the data transfer on the writing line. As used herein, the data transfer means that the image data and control signals corresponding to the writing line is output to source driver 24 to supply the data voltage to the writing line. Gate drive controller 36 performs the writing pulse control. The writing pulse control means that source driver 24 outputs the control signal to gate driver 25 to supply the gate signal writing the data voltage corresponding to the image data acquired by the data transfer in the writing line. Consequently, the data voltage corresponding to the writing line is supplied to the writing line.

Source drive controller 35 does not perform the data transfer on the correlation line. That is, source drive controller 35 does not output the image data and various control signals corresponding to the correlation line to the source driver 24 to supply the data voltage to the correlation line. In other words, because source driver 24 does not newly acquire the image data and the control signal, source driver 24 is in a state in which the data voltage corresponding to the acquired image data is output (held) to supply the data voltage to the writing line.

Gate drive controller 36 also performs the writing pulse control on the correlation line. In this case, the writing pulse control means that the control signal for supplying the gate signal is output to gate driver 25 to write the data voltage (in other words, the data voltage corresponding to the writing line) supplied by source driver 24 in the correlation line. Consequently, the data voltage corresponding to the writing line is supplied to the correlation line.

As described above, when determining that the correlation in the image exists between the non-writing line and the writing line, controller 30 performs the control such that source driver 24 is caused to supply the data voltage corresponding to the writing line, such that gate driver 25 is caused to supply the gate signal to write the data voltage in the writing line, and such that gate driver 25 is caused to supply the gate signal to write the data voltage corresponding to the writing line in the correlation line. For example, it can be said that the correlation determined by determination unit 32 is processing of determining which non-writing line the data voltage corresponding to the writing line is written in.

In step S50, source drive controller 35 does not transfer the data to source driver 24 for the non-writing lines except for the correlation lines, and gate drive controller 36 does not perform the writing pulse control on gate driver 25.

Controller 30 performs the operation in FIG. 3 for each one or a plurality of frames. For example, controller 30 performs the operation in FIG. 3 on each of the plurality of frames.

Figure 5:
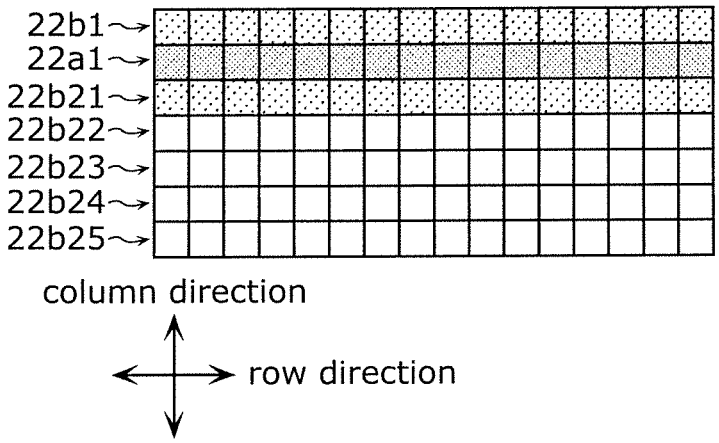
FIG. 5 is a view illustrating the operation when a non-writing line having a correlation with a writing line is located above the writing line in the liquid crystal display device of the first exemplary embodiment.

In step S20, the non-writing line having the correlation with the writing line is likely to be located above the writing line (in a direction opposite to the scanning direction of gate driver 25). The operation of determination unit 32 in this case will be described with reference to FIG. 5. FIG. 5 is a view illustrating the operation when the non-writing line having the correlation with the writing line is located above the writing line in liquid crystal display device 10 of the first exemplary embodiment. FIG. 5 illustrates only the pixel rows included in range R1.

FIG. 5 illustrates the case where the writing line is pixel row 22*a*1, and the case where the pixel rows having the correlation with the writing line are pixel rows 22*b*1 and 22*b*21 in the correlation determination in step S20. That is, the non-writing line having the correlation with the writing line also exists above the writing line. In this case, determination unit 32 decides that the non-writing line (in FIG. 5, pixel row 22*b*1) located on the uppermost side of the non-writing lines having the correlation with the writing line (in FIG. 5, pixel row 22*a*1) with respect to the writing line is the correlation line. Then, the data voltage of pixel row 22*a*1 that is the writing line selected in step S10 is written in the pixel row located above pixel row 22*a*1. Because pixel row 22*b*21 is located below pixel row 22*a*1, pixel row 22*b*21 is set to the correlation line.

Consequently, the writing line and the correlation line corresponding to the scanning direction of gate driver 25 can be set. In this case, in step S50, the data voltage for pixel row 22*a*1 is written in both pixel rows 22*b*1 and 22*b*21.

As described above, when at least one non-writing line having the correlation with the writing line is located on the other side in the column direction with respect to the writing line, controller 30 performs the control such that source driver 24 is caused to output the data voltage corresponding to the writing line, such that gate driver 25 is caused to output the gate signal to write the data voltage in the non-writing line located on the most other side, and such that gate driver 25 is caused to output the gate signal to write the data voltage corresponding to the first pixel row in the first pixel row.

Consequently, although source driver 24 is driven once, the data voltage can be supplied to at least two lines (at least two pixel rows).

The example in which determination unit 32 determines the correlation in all the plurality of writing lines is described above. However, the present disclosure is not limited to the example. Determination unit 32 may determine the correlation with respect to at least one of plurality of writing lines (for example, writing line 22*a*1). For example, determination unit 32 may determine only whether each of non-writing lines 22*b*1 and 22*b*21 to 22*b*25 located in range R1 has the correlation with writing line 22*a*1. For example, when the image includes the moving image and the still image, determination unit 32 may determine the correlation only with respect to the writing line displaying the moving image in the plurality of writing lines.

As described above, liquid crystal display device 10 (an example of the image display device) of the first exemplary embodiment has image display region 21 configured by arranging the plurality of pixels P in a matrix form. Liquid crystal display device 10 includes the plurality of gate signal lines GL respectively disposed in each pixel row 22 including the writing line (an example of the first pixel row) and non-writing line (an example of the second pixel row) different from each other in image display region 21, the plurality of gate signal lines GL being used to select the pixel row 22 in which the data voltage corresponding to the image data is written, gate driver 25 that supplies the gate signal to the plurality of gate signal lines GL, the plurality of data signal lines SL respectively disposed in each pixel column 23 in image display region 21, the plurality of data signal lines SL being used to write the data voltage in pixel P of selected pixel row 22, source driver 24 that supplies the data voltage to the plurality of data signal lines SL, and controller 30 that determines whether the correlation in the image exists between the non-writing line and the writing line and controls gate driver 25 and source driver 24 based on the determination result. When determining that the non-writing line has the correlation with the writing line in the image, controller 30 performs the control such that source driver 24 is caused to supply the data voltage corresponding to the writing line, such that gate driver 25 is caused to supply the gate signal to write the data voltage in the writing line, and such that gate driver 25 is caused to supply the gate signal to write the data voltage corresponding to the writing line in the non-writing line.

Consequently, controller 30 does not output the image data and various control signals corresponding to the second pixel row to source driver 24 when supplying the data voltage to the second pixel row having the correlation with the first pixel row. That is, source driver 24 maintains the data voltage supplied to the first pixel row during a timing when the data voltage can be supplied to the second pixel row. Thus, because source driver 24 is driven once when the data voltage is written in the first pixel row and the second pixel row having the correlation with the first pixel row, the number of drive times of source driver 24 in one frame is reduced, leading to the reduction of the power consumed by source driver 24. That is, the power consumed by liquid crystal panel 20 including image display region 21, source driver 24, and gate driver 25 is reduced. Because the second pixel row has the correlation with the first pixel row in the image, the image quality degradation is hardly generated even if the data voltage of the first pixel row is written in the second pixel row.

Thus, liquid crystal display device 10 can reduce the power consumed in liquid crystal panel 20 while preventing the generation of the image quality degradation. Since the power consumed by source driver 24 has a large ratio of the power consumed by liquid crystal panel 20, the power consumed by liquid crystal panel 20 can effectively be reduced by decreasing the number of drive times of source driver 24.

Controller 30 controls gate driver 25 and source driver 24 such that respective data voltage is written in every predetermined pixel rows 22 among the plurality of pixel rows 22 in one frame among the plurality of frames. The first pixel row is the pixel row (writing line) in which the data voltage is written. The second pixel row is the pixel row (non-writing line) in which the data voltage is not written when controller 30 determines that the first pixel row does not have the correlation in one frame.

Consequently, the power consumption of the liquid crystal panel can be further reduced due to the existence of the non-writing lines in one frame. When the non-writing line has the correlation with the writing line in the image, the data voltage corresponding to the writing line is supplied to the non-writing line. Consequently, the frame frequency is increased in the non-writing line, so that the generation of the image quality deterioration due to the charge loss can be prevented. The data voltage corresponding to the correlation line in the frame after the data voltage of the writing line, which is the data voltage similar to the data voltage corresponding to the correlation line, is written in the correlation line. Consequently, the generation of the image quality degradation due to the decrease in frame frequency of the pixel row can be prevented.

When the data voltage of the writing line is supplied to the non-writing line, the data transfer is not performed from controller 30 to source driver 24. That is, source driver 24 consumes little power when the data voltage of the writing line is supplied to the non-writing line. In other words, the number of pixel rows in which the data voltage is written can be increased without increasing the power consumed by source driver 24.

The data voltage is not supplied to the non-writing line determined not to have the correlation in the frame. Consequently, the numbers of drive times of source driver 24 and gate driver 25 in one frame can be decreased, leading to the further reduction of the power consumption.

Thus, liquid crystal display device 10 can further reduce the power consumed in the liquid crystal panel while further preventing the generation of the image quality degradation.

Controller 30 controls source driver 24 so as to perform the column inversion drive in which the polarities of the data voltage supplied to two adjacent data signal lines SL are different from each other. The plurality of writing lines (an example of the first pixel row) exist in one frame. Controller 30 determines whether the correlation in the image exists between the writing line (for example, writing line 22*a*2) located in the center in the column direction in three writing lines arranged side by side and each of at least two non-writing lines (an example of the second pixel row, for example, non-writing lines 22*b*21 to 22*b*25 and 22*b*31 to 22*b*35) disposed between the writing line and the rest two writing lines (for example, writing lines 22*a*1 and 22*a*3).

Consequently, the power consumed by the liquid crystal panel can be reduced even if controller 30 controls source driver 24 so as to perform the column inversion drive. For example, the generation of the image quality deterioration can further be prevented because the number of non-writing lines in which whether the non-wiring line has the correlation with one writing line is determined is increased as compared with the case where controller 30 performs the row line inversion drive.

Gate driver 25 sequentially supplies the gate signal to the plurality of pixel rows 22 in order toward one side in the column direction. When one non-writing line having the correlation with the writing line is located on the other side in the column direction with respect to the writing line, controller 30 performs the control such that source driver 24 is caused to supply the data voltage corresponding to the writing line, such that gate driver 25 is caused to supply the gate signal to write the data voltage in the non-writing line located on the other side, and such that gate driver 25 is caused to supply the gate signal to write the data voltage corresponding to the writing line in the writing line.

Consequently, the writing line and the correlation line corresponding to the scanning direction of gate driver 25 can be set.

Controller 30 may determine whether, in at least one first pixel constituting the writing line and at least one second pixel constituting the non-writing line, a difference in pixel value between the first pixel and the second pixel disposed in identical pixel column 23 falls within a predetermined value, and determine that the non-writing line has the correlation with the writing line when the number of second pixels in which the difference in pixel value falls within a predetermined value is greater than or equal to a predetermined number. Controller 30 may calculate, in at least one first pixel constituting the writing line and at least one second pixel constituting the non-writing line, the score according to the difference in pixel value for the first pixel and the second pixel disposed in identical pixel column 23, and determine that the non-writing line has the correlation with the writing line when the correlation value indicating the degree of image correlation between the non-writing line and the writing line is greater than or equal to a predetermined value based on the calculated scores.

Consequently, the correlation can easily be determined using the number of pixels or the score.

As described above, the display method of liquid crystal display device 10 of the first exemplary embodiment is a display method of liquid crystal display device 10 including image display region 21 configured by arranging the plurality of pixels P in a matrix form. Whether the non-writing line has the correlation with the writing line in the image is determined (corresponding to S20) in the writing line (an example of the first pixel row) and the non-writing line (an example of the second pixel row) different from each other in image display region 21. When the non-writing line is determined to have the correlation with the writing line, source driver 24 is caused to supply the data voltage corresponding to the writing line, gate driver 25 is caused to supply the gate signal to write the data voltage in the writing line, and gate driver 25 caused to supply the gate signal to write the data voltage corresponding to the writing line in the non-writing line (corresponding to S50).

First Modification of First Exemplary Embodiment

Figure 6:
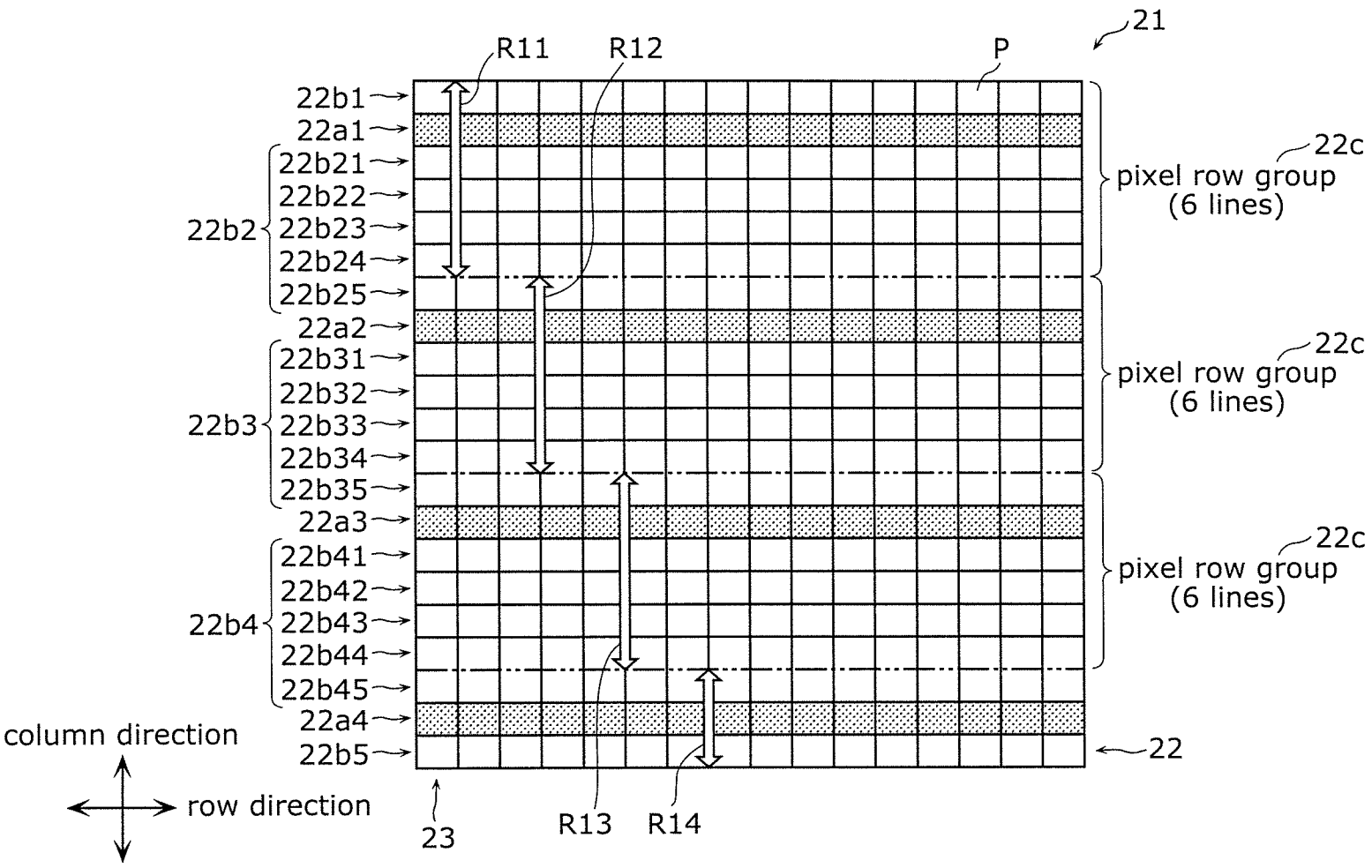
FIG. 6 is a view illustrating the range in which the correlation is compared in the liquid crystal display device according to a first modification of the first exemplary embodiment.

A liquid crystal display device according a modification will be described below with reference to FIG. 6. FIG. 6 is a view illustrating a range where the correlation is compared in the liquid crystal display device of the first modification. In the first modification, a difference from liquid crystal display device 10 of the first exemplary embodiment will mainly be described. The configuration of the liquid crystal display device of the first modification is the same as liquid crystal display device 10 of the first exemplary embodiment, and the description will be omitted or simplified.

An example in which controller 30 controls source driver 24 so as to perform row line inversion drive (N-line inversion drive) in which the polarity of the data voltage supplied to the plurality of data signal lines SL varies for each pixel row group 22*c* constructed with n (n is an integer of 2 or more) pixel rows will be described in the first modification. The range where determination unit 32 compares the correlation with the writing line when source driver 24 performs the row line inversion drive will be described with reference to FIG. 6. FIG. 6 illustrates the case where N (N is an integer of 1 or more) lines are six lines.

As illustrated in FIG. 6, the range where determination unit 32 compares the correlation with writing line 22*a*1 is range R11 including non-writing lines 22*b*1 and 22*b*21 to 22*b*24. That is, determination unit 32 determines whether the correlation exists between writing line 22*a*1 and each of non-writing lines 21*b*1 and 22*b*21 to 22*b*24. Non-writing lines 22*b*1 and 22*b*21 to 22*b*24 are the pixel row in which the polarity of the data voltage for the pixels arranged in the column direction is the same as that of writing line 22*a*1.

The range where determination unit 32 compares the correlation with writing line 22*a*2 is range R12 including non-writing lines 22*b*25 and 22*b*31 to 22*b*34. That is, determination unit 32 determines whether the correlation exists between writing line 22*a*2 and each of non-writing lines 22*b*25 and 22*b*31 to 22*b*34. In non-writing lines 22*b*25 and 22*b*31 to 22*b*34, the polarity of the data voltage for the pixels arranged in the column direction is the same as that of writing line 22*a*2. Similarly, in writing lines 22*a*3 and 22*a*4, determination unit 32 determines the correlation with each of the non-writing lines having the same polarity of the data voltage for the pixels arranged in the column direction as that of writing lines 22*a*3 and 22*a*4. The polarities of the data voltages for the pixels arranged in the column direction in the adjacent pixel row groups 22*c* are different from each other.

As described above, for example, determination unit 32 determines whether the correlation exists between the writing line and at least one non-writing line included in pixel row group 22*c* in which the writing line is disposed. In other words, determination unit 32 determines whether the correlation exists between the writing line and each of the non-writing lines having the same polarity of the data voltage in the pixels of the writing line and the pixels arranged in the column direction.

When controller 30 inverts the polarity of the data voltage for each frame in the frame inversion drive, a number of pixel rows 22 constituting pixel row group 22*c* may be an odd number in order to prevent the data voltage having the same polarity from being supplied to one pixel row.

As described above, controller 30 of the liquid crystal display device of the first modification controls source driver 24 so as to perform the row line inversion drive in which the polarity of the data voltage supplied to the plurality of data signal lines SL varies for each pixel row group 22*c* constructed with consecutive n (n is an integer of 2 or more) pixel rows. The writing line (an example of the first pixel row) is disposed for each pixel row group 22*c*. Controller 30 determines whether the correlation in the image exists between the writing line and at least one non-writing line included in pixel row group 22*c* in which the writing line is disposed.

Consequently, the power consumed by the liquid crystal panel can be reduced even if controller 30 performs the column inversion drive.

Second Modification of First Exemplary Embodiment

In the liquid crystal display devices of the first exemplary embodiment and the first modification of the first exemplary embodiment, the number of pixel rows (in other words, the number of non-writing lines that are the pixel row in which the data voltage is not written) constituting pixel row group 22*c* is restricted when the frame inversion drive is the drive in which the polarity of the data voltage is inverted for each frame. On the other hand, a liquid crystal display device that does not receive the restriction will be described in the second modification.

Figure 7:
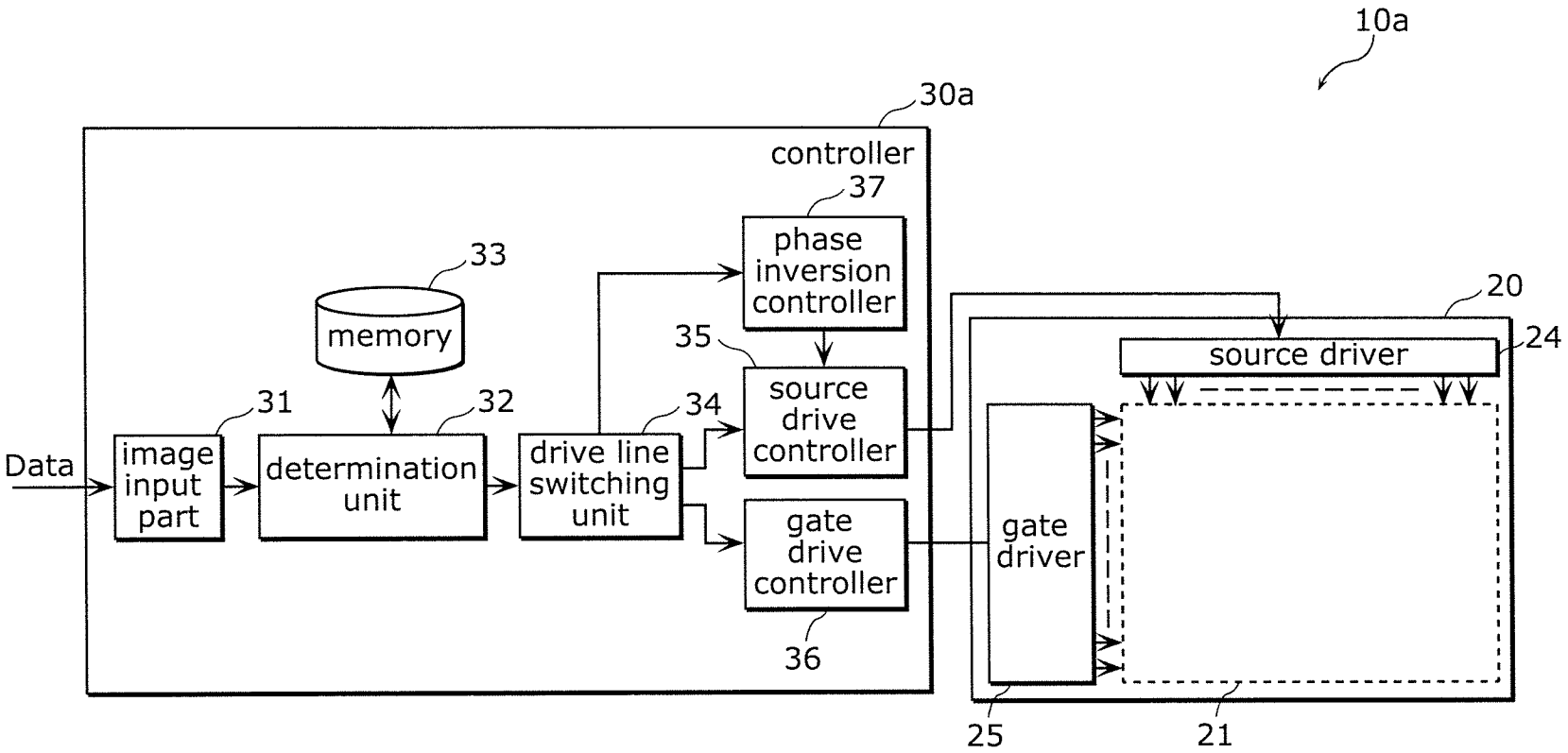
FIG. 7 is a block diagram illustrating a functional configuration of a liquid crystal display device according to a second modification of the first exemplary embodiment.

Liquid crystal display device 10*a* of the second modification will be described below with reference to FIGS. 7 and 8. FIG. 7 is a block diagram illustrating a functional configuration of liquid crystal display device 10*a* of the second modification.

As illustrated in FIG. 7, liquid crystal display device 10*a* of the second modification includes controller 30*a* instead of controller 30 included in liquid crystal display device 10 of the first exemplary embodiment. Controller 30*a* of the second modification further includes phase inversion controller 37 in addition to controller 30 of the first exemplary embodiment. Phase inversion controller 37 will mainly be described below.

In the N-row line inversion drive in which the inversion control is performed for each frame or every plurality of lines, a polarity control signal (POL) supplied to source driver 24 is controlled such that start polarity of a display start line is inverted in units of frames, and such that the polarity is inverted in units of N lines.

Phase inversion controller 37 controls the start polarity of the polarity inversion signal and the number of lines of the first N rows in units of frames, and causes source drive controller 35 to supply the polarity control signal to source driver 24. Source driver 24 switches the polarity of the data voltage based on the polarity control signal that is the control signal deciding the polarity of the data voltage output from source drive controller 35.

An example of the phase inversion control performed by phase inversion controller 37 will be described with reference to FIG. 8. FIG. 8 is a view illustrating an example of the phase inversion control of liquid crystal display device 10*a* of the second modification. FIG. 8 illustrates an example in which image display region 21 has 16 pixel rows and 7 pixel columns. Signs "+" and "−" illustrated beside image display region 21 indicate a phase of the data voltage for each pixel P.

Figure 8:
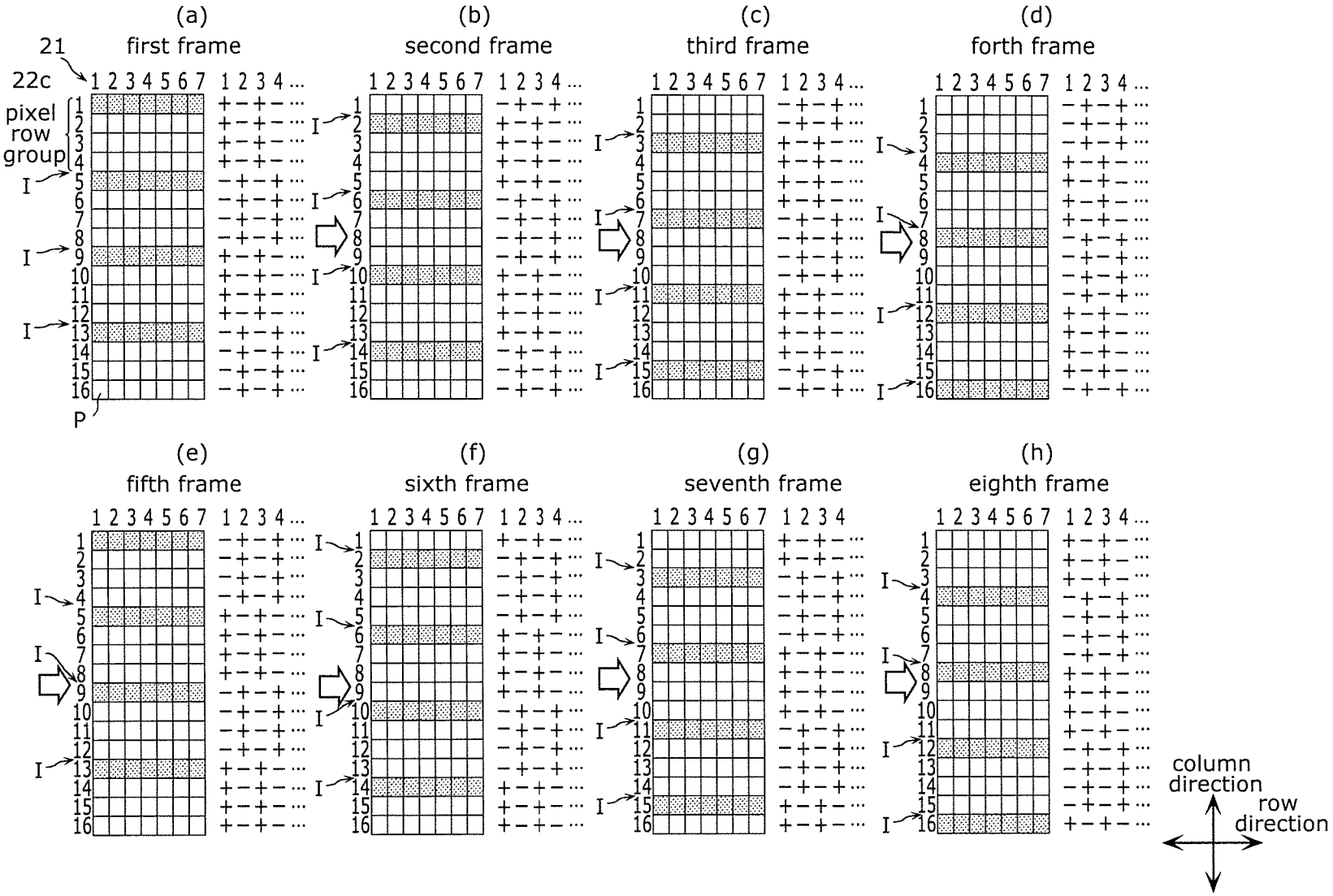
FIG. 8 is a view illustrating an example of phase inversion control in the liquid crystal display device of the second modification of the first exemplary embodiment.

As illustrated in a part (a) of FIG. 8, pixel rows 1, 5, 9, and 13 are the writing line in the first frame. An example in which the polarity of the data voltage varies every four pixel rows (each pixel row group 22*c*) is illustrated in the part (a) of FIG. 8. That is, inversion position I where the polarity is inverted every four pixel rows exists. In the first frame, inversion position I is located at a boundary between pixel rows 4 and 5, a boundary between pixel rows 8 and 9, and a boundary between pixel rows 12 and 13.

As illustrated in a part (b) of FIG. 8, pixel rows 2, 6, 10, and 14 are the writing line in the second frame. In the second frame, inversion position I is located at the boundary between pixel rows 1 and 2, the boundary between pixel rows 5 and 6, the boundary between pixel rows 9 and 10, and the boundary between pixel rows 13 and 14. That is, for example, as illustrated in the parts (a) and (b) of FIG. 8, phase inversion controller 37 shifts inversion position I by one pixel row for every one or every plurality of frames. In the second modification, phase inversion controller 37 shifts inversion position I for every frame. In other words, phase inversion controller 37 causes source drive controller 35 to output the polarity control signal such that inversion position I is shifted every frame.

As illustrated in parts (c) to (h) of FIG. 8, even after the third frame, phase inversion controller 37 sequentially shifts inversion position I for every frame. In the next frame after the eighth frame, the polarity of the data voltage is the same as the first frame.

In FIG. 8, phase inversion controller 37 shifts inversion position I at which the phase is inverted by one pixel row for each frame. However, the number of shifted pixel rows is not limited to one pixel row. Phase inversion controller 37 may shift inversion position I by each odd-numbered pixel rows (for example, 3 lines) for each frame. The example in which the polarity of the data voltage varies every four pixel rows is described in FIG. 8. However, the number of pixel rows having the different polarities of the data voltage is not limited to the example in FIG. 8. When the pixel rows having the same polarity are N lines, the number of N lines (in FIG. 8, 4 lines) is preferably large from the viewpoint of the reduction of the power consumption. For example, the N lines may be greater than or equal to 4 lines.

When the number of N lines is increased, a horizontal streak (luminance unevenness) becomes conspicuous due to the difference between writing during the same polarity and writing during the polarity inversion (such as deficiency and excess writing) at inversion position I. However, phase inversion controller 37 can shift inversion position I to prevent the horizontal streak from being visually recognized.

In the example of FIG. 8, phase inversion controller 37 shifts inversion position I for each frame. Alternatively, phase inversion controller 37 may shift inversion position I for each at least two frames.

As described above, phase inversion controller 37 of liquid crystal display device 10*a* of the second modification inverts the phase of the polarity of the data voltage in units of m (m is an integer of 1 or more) pixel rows, and shifts position of pixel row 22 where the phase of the polarity of the data voltage is inverted by a predetermined pixel row for every predetermined frames.

Consequently, even if the frame inversion drive is the drive in which the polarity of the data voltage is inverted every frame, and even if m (number of N lines) is an even number, the data having the same polarity can be prevented from being supplied to the pixel row, so that the generation of the image quality degradation can further be prevented.

Second Exemplary Embodiment

A liquid crystal display device according to a second exemplary embodiment will be described below with reference to FIGS. 9 to 13.

[2-1. Configuration of Liquid Crystal Display Device]

Figure 9:
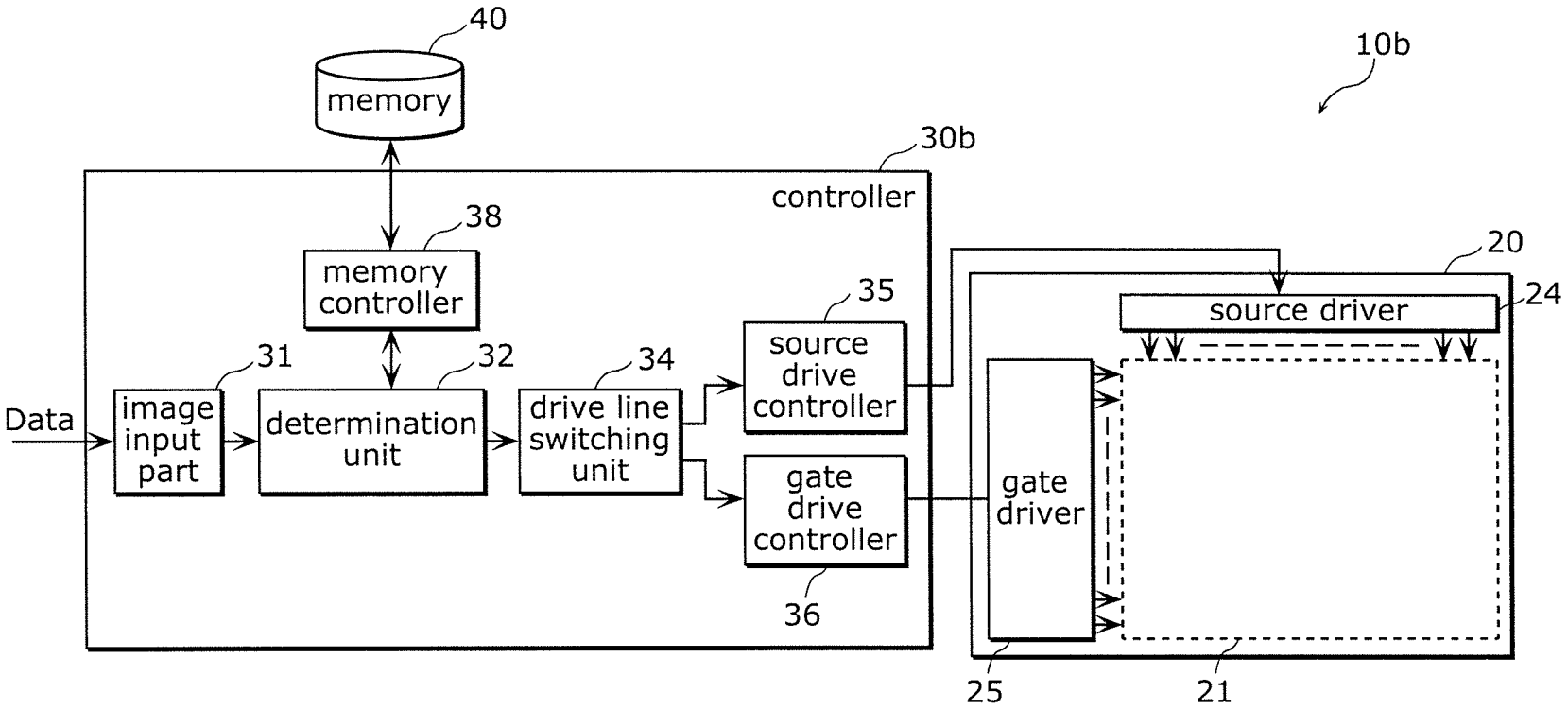
FIG. 9 is a block diagram illustrating a functional configuration of a liquid crystal display device according to a second exemplary embodiment.

A schematic configuration of liquid crystal display device 10*b* of the second exemplary embodiment will be described below with reference to FIG. 9. FIG. 9 is a block diagram illustrating a functional configuration of liquid crystal display device 10*b* of the second exemplary embodiment.

As illustrated in FIG. 9, liquid crystal display device 10*b* of the second exemplary embodiment includes controller 30*b* instead of controller 30 included in liquid crystal display device 10 of the first exemplary embodiment. Liquid crystal display device 10*b* includes memory 40 instead of memory 33 included in controller 30 of the first exemplary embodiment.

As illustrated in FIG. 9, controller 30*b* includes image input unit 31, determination unit 32, drive line switching unit 34, source drive controller 35, gate drive controller 36, and memory controller 38. The configurations of image input unit 31, determination unit 32, drive line switching unit 34, source drive controller 35, and gate drive controller 36 are the same as those of controller 30 of the first exemplary embodiment, and the description will be omitted. Memory controller 38 and memory 40 will mainly be described below. Controller 30*b* of the second exemplary embodiment controls gate driver 25 and source driver 24 such that the data voltage is written in each of the plurality of pixel rows 22 for each of the plurality of frames.

Memory controller 38 is a control device that controls the writing and reading of the image data in and from memory 40. Memory controller 38 stores the image data for at least one frame in memory 40. Memory controller 38 may control the writing and reading of the result of the correlation determination performed by determination unit 32 in and from memory 40.

For example, memory controller 38 writes the image data and the determination result output from determination unit 32 in memory 40, and outputs the image data and the determination result read from memory 40 to determination unit 32.

Memory 40 has a storage capacity storing the image data used to determine the correlation in determination unit 32. Memory 40 has a storage capacity capable of storing the image data for at least one frame.

[2-2. Operation of Liquid Crystal Display Device]

Figure 10:
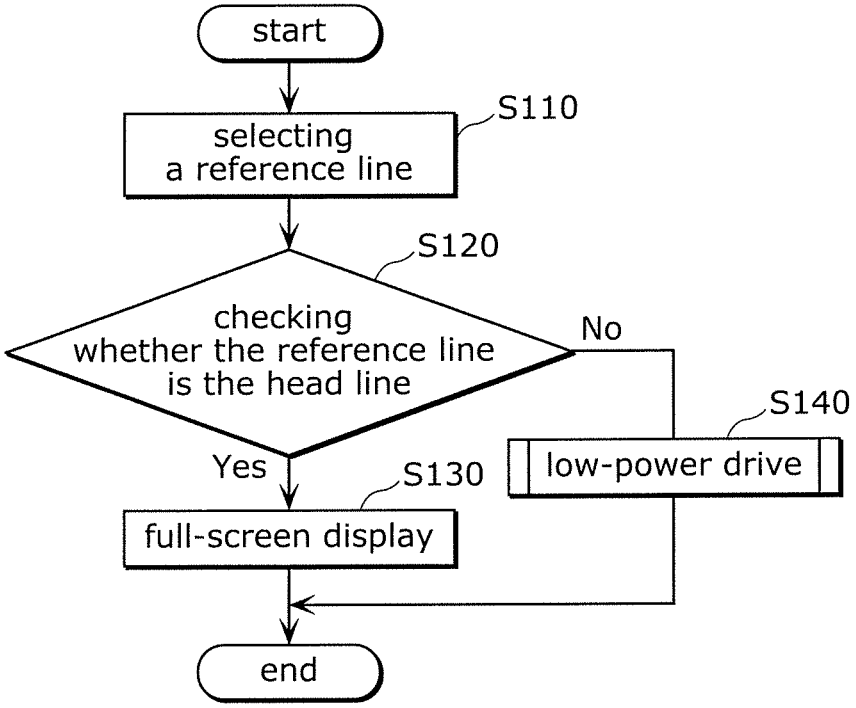
FIG. 10 is a flowchart illustrating the operation of the liquid crystal display device of the second exemplary embodiment.
Figure 11:
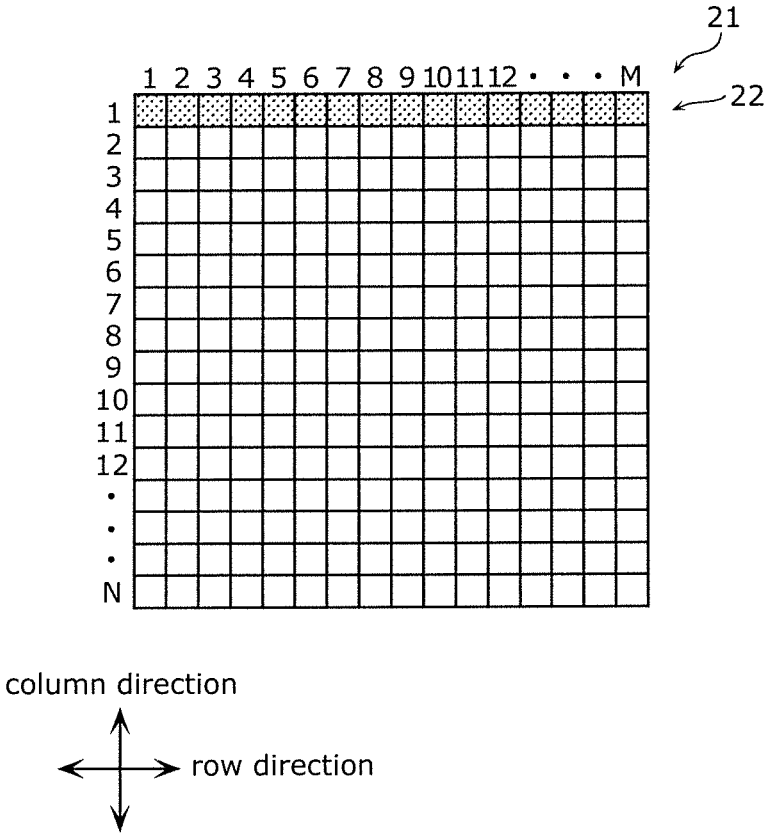
FIG. 11 is a view illustrating a case where the correlation is not compared in the liquid crystal display device of the second exemplary embodiment.

The operation of liquid crystal display device 10*b* will be described below with reference to FIGS. 10 to 13. FIG. 10 is a flowchart illustrating the operation of liquid crystal display device 10*b* of the second exemplary embodiment. FIG. 11 is a view illustrating the case where the correlation is not compared in liquid crystal display device 10*b* of the second exemplary embodiment.

As illustrated in FIG. 10, controller 30*b* selects a reference line that is pixel row 22 serving as a reference used to compare the correlation with other pixel rows 22 (S110). Determination unit 32 selects the reference line in the frame for each frame from the plurality of pixel rows 22. An example of the control for selecting 10 reference lines will be described. Determination unit 32 previously includes a head line (pixel row 1 in FIG. 11) as the reference line, arbitrarily selects 9 rows from N columns of pixel row 22 in FIG. 11, and selects the reference lines different from each other in each of 10 consecutive frames. The reference line is an example of the first pixel row. FIG. 11 illustrates only one reference line in the selected 10 reference lines. The same also applies to FIG. 13 (to be described later).

Determination unit 32 determines whether the reference line selected in step S110 is the head line (S120). The head line is an example of the predetermined pixel row that is previously determined. An example in which the predetermined pixel row is the head line (uppermost pixel row 22) will be described below. However, the predetermined pixel row may not be pixel row 22 located at the head as long as the predetermined pixel row is the pixel row 22 previously selected from the plurality of pixel rows 22. The number of predetermined pixel rows is not limited to one, but at least two predetermined pixel rows may be selected.

When determination unit 32 determines that pixel row 22 selected as the reference line is the head line (Yes in S120), controller 30*b* controls source driver 24 and gate driver 25 to perform the full-screen display (S130). That is, when the affirmative determination is made in step S120, determination unit 32 does not determine the correlation between the reference line selected in step S110 and other pixel rows 22. For example, as illustrated in FIG. 11, when pixel row 1 having the hatched dot is the reference line, determination unit 32 determines that the reference line is the head line. FIG. 11 illustrates an example in which the reference line in a certain frame is the pixel row 1. FIG. 11, the pixel row having the hatched dot represents the reference line.

In step S130, source drive controller 35 outputs the image data to source driver 24 for each pixel row 22. Source driver 24 writes the data voltage corresponding to the image data of pixel row 22 for each pixel row 22. Consequently, the image for one frame is displayed.

On the other hand, when determination unit 32 determines that the reference line is not the head line (No in S120), controller 30*b* controls source driver 24 and gate driver 25 to perform low-power drive (S140). That is, when the negative determination is made in step S120, determination unit 32 determines the correlation between the reference line selected in step S110 and other pixel rows 22.

Figure 12:
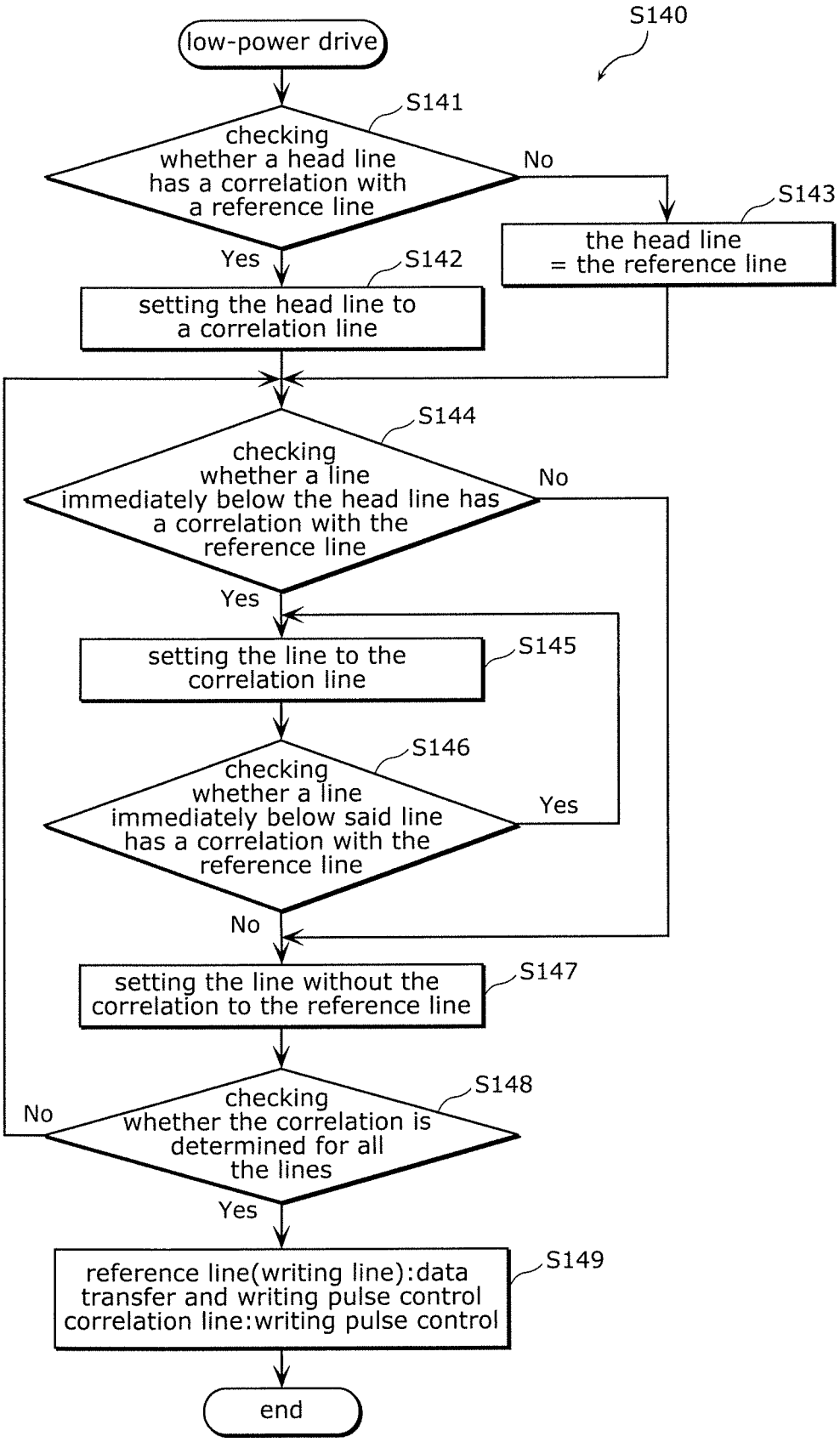
FIG. 12 is a flowchart illustrating operation of the liquid crystal display device of the second exemplary embodiment.
Figure 13:
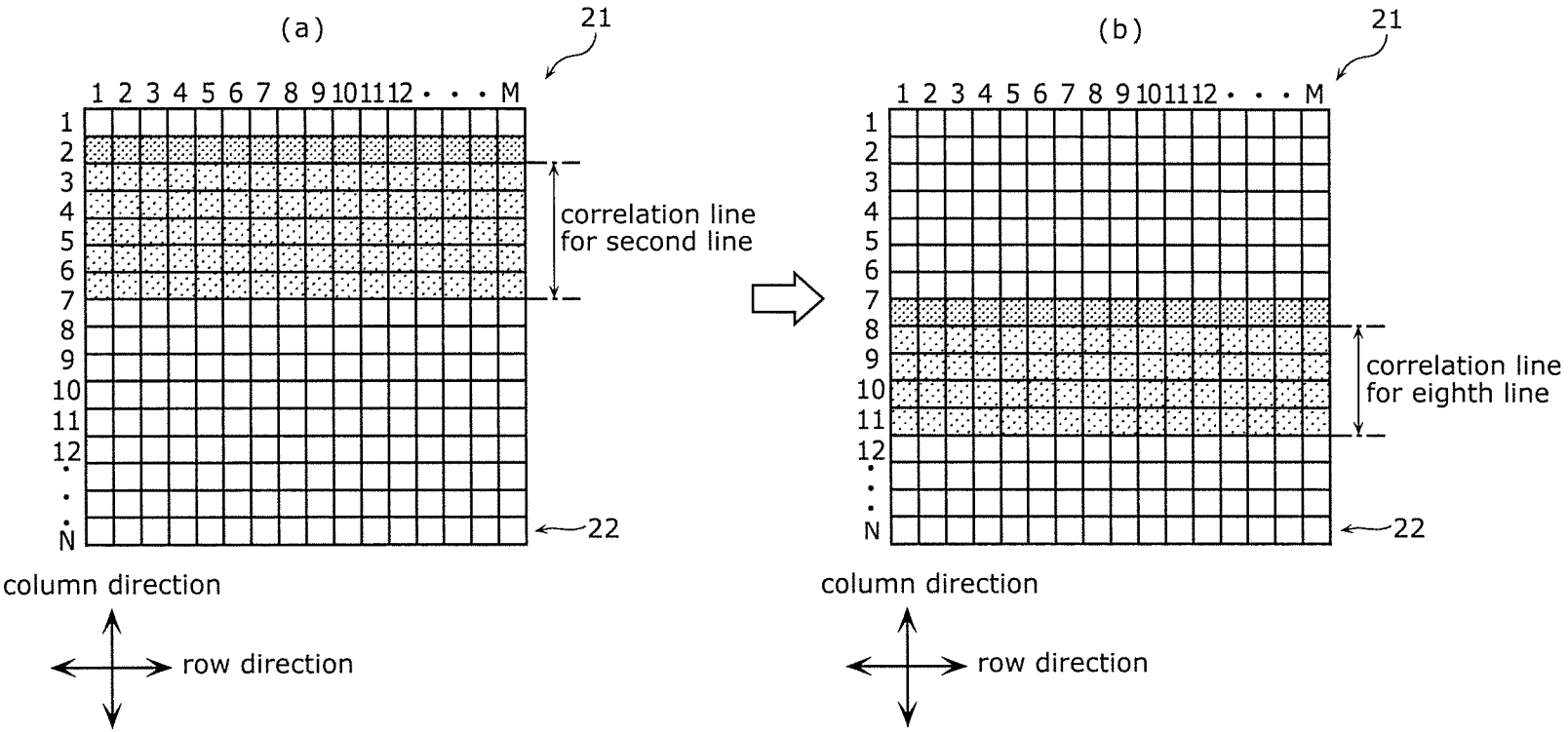
FIG. 13 is a view illustrating the comparison of the correlation in the liquid crystal display device of the second exemplary embodiment.

Details of step S140 will be described below with reference to FIGS. 12 and 13. FIG. 12 is a flowchart illustrating the operation of liquid crystal display device 10*b* of the second exemplary embodiment. FIG. 13 is a view illustrating the comparison of the correlation in liquid crystal display device 10*b* of the second exemplary embodiment. FIG. 13 illustrates the case where controller 30*b* controls source driver 24 by the column inversion drive. FIG. 13 illustrates two hatched dots, and illustrates an example in which pixel row 22 having the high-density hatched dot is the reference line while pixel row 22 having the low-density hatched dot is the correlation line.

As illustrated in FIG. 12, determination unit 32 determines whether the reference line selected for each frame has the correlation with the reference line for each line in the scanning direction in order from the head line. Determination unit 32 determines whether the head line has the correlation with the reference line (S141). In a part (a) of FIG. 13, the reference line is pixel row 2, and whether the correlation exists is determined from pixel row 1 (head line). When determining that the head line has the correlation with the reference line (Yes in S141), determination unit 32 performs the control to write the data voltage of the reference line in the head line. That is, the head line is set to the correlation line (S142). When determining that the head line does not have the correlation with the reference line (No in S141), determination unit 32 sets the head line to the reference line (S143).

Subsequently, the correlation is sequentially determined in the column direction. Determination unit 32 determines whether the line (pixel row 22) immediately below the head line has the correlation with the reference line (S144). In the second exemplary embodiment, the line immediately below the head line is the reference line (pixel row 2) selected in step S110. When the negative determination is made in step S141, for example, when the reference line is located at a scanning position of the initial reference line (the reference line selected in step S110, pixel row 2 in the part (a) of FIG. 13) of the frame, the correlation is not determined, but the initial reference line (pixel row 2) is set to the reference line again, and whether the reference line set again has the correlation with the subsequent lines is sequentially determined. In this case, for example, in step S144, whether the line (pixel row 3) immediately below the reference line set again has the correlation with the reference line set again is determined.

When pixel row 3 is determined to have the correlation with pixel row 2 that is the reference line (Yes in S144), pixel row 3 is set to the correlation line for pixel row 2 (S145). Then, determination unit 32 determines whether the pixel row immediately below pixel row 3 has the correlation with the reference line (S146). Specifically, determination unit 32 determines whether pixel row 4 that is the pixel row immediately below pixel row 3 has the correlation with pixel row 2 that is the reference line. In this case, pixel row 2 is an example of the first pixel row and the first comparison reference line, and the pixel rows (for example, pixel rows 3 to N) that includes pixel row 3 and is located below pixel row 2 are an example of the second pixel row.

When determining that pixel row 4 has the correlation with pixel row 2 (Yes in S146), determination unit 32 sets pixel row 4 to the correlation line for pixel row 2 (S145). Then, determination unit 32 determines whether the pixel row immediately below pixel row 3 has the correlation with the reference line (S146). As described above, determination unit 32 sequentially determines the correlation between the reference line and pixel row 22 along the scanning direction of gate driver 25. Determination unit 32 repeatedly performs the pieces of processing in steps S145 and S146 until the negative determination is made in step S146. Consequently, the pixel row except for the reference line is set to the correlation line for pixel row 2 as long as the pixel row except for the reference line has the correlation with pixel row 2 that is the reference line selected in step S110.

When determining that the pixel row does not have the correlation with the reference line (No in S146), determination unit 32 newly sets the pixel row determined not to have the correlation to the reference line (S147). The part (a) of FIG. 13 illustrates the case where the pixel rows up to pixel row 7 have the correlation with pixel row 2 that is the reference line selected in step S110 while pixel row 8 does not have the correlation with pixel row 2. Pixel row 8 is the first pixel row determined not to have the correlation with the pixel row 2 that is the reference line in the sequential determination of the correlation. At this point, the correlation lines for pixel row 2 that is the reference line are pixel rows 3 to 7 (see the correlation line for the second line in the part (a) of FIG. 13). As illustrated in a part (b) of FIG. 13, determination unit 32 newly sets pixel row 8 that is the first pixel row determined not to have the correlation to the reference line.

When the negative determination is made in step S144, the processing proceeds to step S147 to perform the above processing.

Subsequently, determination unit 32 determines whether the above determination is made for all the lines (pixel rows) (S148). When determining that the above determination is made for all the lines (Yes in S148), determination unit 32 proceeds to step S149. The processing in step S149 is the same as that in step S50 in FIG. 4.

When determining that the above determination is not made for all the lines (No in S148), determination unit 32 proceeds to step S144 to continue the determination processing. In the example of the part (b) in FIG. 13, determination unit 32 makes the negative determination in step S148 because the pixels after pixel row 9 that are not subjected to the determination processing exist below pixel row 8, and the processing in step S144 is performed. Specifically, determination unit 32 determines whether pixel row 9 that is the pixel row immediately below pixel row 8 that is the reference line has the correlation with pixel row 8 that is the reference line set in step S147 (S144). Thereafter, the pieces of processing in steps S144 to S147 are repeatedly performed until the affirmative determination is made in step S148.

The part (b) of FIG. 13 illustrates the case where pixel rows 9 to 12 have the correlation with pixel row 8 that is the reference line selected in step S147. At this point, the correlation lines for pixel row 8 that is the reference line are pixel rows 9 to 12 (see the correlation line for the eighth line in the part (b) of FIG. 13). In this case, pixel row 8 is an example of the second comparison reference line, and the pixel rows (for example, pixel rows 9 to N) located below pixel row 8 including pixel row 9 are an example of the third pixel row.

As described above, liquid crystal display device 10*b* includes memory 40 (frame memory), so that the correlation of all lines can be compared. The pieces of processing in steps S147 and S148 may not be performed. For example, determination unit 32 may determine the correlation only on the reference line selected in step S110. However, in this case, the processing in FIG. 3 may be performed on the pixel row above the reference line in the scanning direction of the frame.

In the next frame, the pixel rows except for pixel rows 1 and 2 are set to the reference line. The selection of the pixel row serving as the reference line is randomly performed for each frame. The reference line may not sequentially be selected in the arrangement direction of the pixel rows, or may be sequentially selected.

The example in which controller 30*b* controls source driver 24 to perform the column inversion drive is described above. However, when source driver 24 is controlled to perform the row line inversion drive, the above processing is performed for each pixel row group (see pixel row group 22*c* in FIG. 6) having the same polarity of the data voltage.

Determination unit 32 may determine whether to perform the operation in FIG. 10 according to the displayed image. For example, determination unit 32 may determine whether to perform the operation in FIG. 10 based on an analysis result of the image data for one frame. Determination unit 32 may determine that the operation in FIG. 10 is performed when the number of pixel rows having the correlation with one pixel row is greater than or equal to a predetermined number. Determination unit 32 may determine that the operation in FIG. 4 is performed when the number of pixel rows having the correlation with one pixel row is less than the predetermined number. In this way, determination unit 32 may further determine that the operation to increase the effect that reduces the power consumption is performed according to the displayed image.

As described above, controller 30*b* of liquid crystal display device 10*b* of the second modification controls gate driver 25 and source driver 24 to write respective data voltage in each of the plurality of pixel rows 22 for each of the plurality of frames. Liquid crystal display device 10*b* further includes memory 40 that can store the image data for one frame. When the reference line (an example of the first pixel row) is a predetermined head line (an example of the predetermined pixel row), controller 30*b* controls gate driver 25 and source driver 24 to write the data voltage corresponding to pixel row 22 in each of the plurality of pixel rows 22 in one frame. When the reference line is not the head line, controller 30*b* sets the reference line to the first comparison reference line in one frame, sequentially determines the correlation in the image between the first comparison reference line and at least one pixel row (an example of the second pixel row) disposed closer to one side in the column direction than the first comparison reference line, and controls gate driver 25 and source driver 24 to write the data voltage corresponding to the first comparison reference line in each of pixel rows 22 determined to have the correlation.

Consequently, for example, when the display having the high correlation in the image for each pixel row 22 such as a full white pattern is performed, the power consumption can effectively be reduced.

Thus, liquid crystal display device 10*b* can effectively reduce the power consumed in the liquid crystal panel while preventing the generation of the image quality degradation.

When determining that the head line in image display region 21 has the correlation with the first comparison reference line, controller 30*b* controls gate driver 25 and the source driver 24 to write the data voltage corresponding to the first comparison reference line in the head line. When determining that the head line in image display region 21 does not have the correlation with the first comparison reference line, controller 30*b* sets the head line to the first comparison reference line, and controls gate driver 25 and source driver 24 to write the data voltage corresponding to the head line in the head line.

Consequently, the appropriate data voltage can be written to the head line according to the determination of the correlation with the first comparison reference line.

Controller 30*b* sequentially determines whether pixel row 22 has the correlation with the first comparison reference line for every pixel row 22 including the first pixel row. When the first pixel row becomes pixel row 22 in which the correlation is determined, controller 30*b* stops the determination of the correlation with the first pixel row, and sets the first pixel row to the first comparison reference line again.

Consequently, the first pixel row that is originally set to the first comparison reference line in the frame is prevented from being not set to the first comparison reference line due to the setting of the head line to the first comparison reference line. Thus, the image quality degradation generated by the improper setting of the first comparison reference line can be prevented.

Further, controller 30*b* further sets the second pixel row initially determined not to have the correlation with the first comparison reference line in the plurality of second pixel rows to the second comparison reference line, sequentially determines the correlation in the image between the second comparison reference line and at least one pixel row (an example of the third pixel row) disposed closer to one side than the second comparison reference line, and controls gate driver 25 and source driver 24 to write the data voltage corresponding to the second comparison reference line in each of the third pixel rows determined to have the correlation. Controller 30*b* may further control the correlation determination processing up to the last line in the scanning direction.

Consequently, liquid crystal display device 10*b* can further effectively reduce the power consumed in the liquid crystal panel.

Third Exemplary Embodiment

[3-1. Configuration of Liquid Crystal Display Device]

Figure 14:
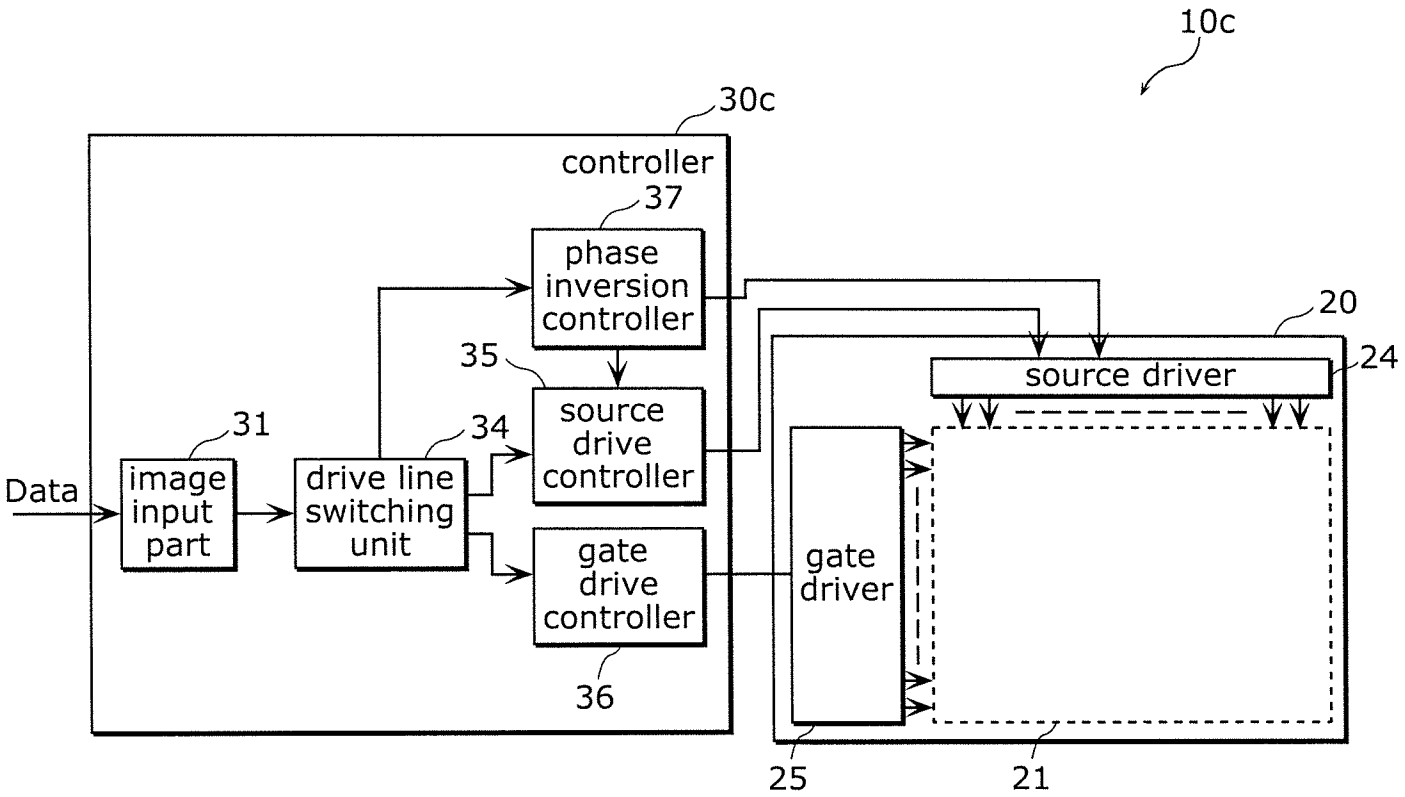
FIG. 14 is a block diagram illustrating a functional configuration of a liquid crystal display device according to a third exemplary embodiment.

Liquid crystal display device 10*c* according to a third exemplary embodiment will be described below with reference to FIG. 14. FIG. 14 is a block diagram illustrating a functional configuration of liquid crystal display device 10*c* of the third exemplary embodiment.

As illustrated in FIG. 14, liquid crystal display device 10*c* includes liquid crystal panel 20 and controller 30*c*. Controller 30*c* includes image input unit 31, drive line switching unit 34, source drive controller 35, gate drive controller 36, and phase inversion controller 37. In other words, controller 30*c* does not include a determination unit (for example, determination unit 32 of the first exemplary embodiment) that compares the correlation between the first pixel row and the second pixel row. For example, liquid crystal display device 10*c* writes the data voltage in each of the plurality of pixel rows 22 in each frame. That is, in liquid crystal display device 10*c*, each of the plurality of pixel rows 22 is the writing line for each frame, and full-screen display is performed.

The effect illustrated in the second modification of the first exemplary embodiment is obtained even in liquid crystal display device 10*c* that does not include the determination unit and performs the full-screen display.

In the liquid crystal panel, shadowing (a phenomenon in which a shadow around the image and vertical and horizontal stripes are visible) is easily generated due to a panel structure in the column inversion drive. Sometimes N-line inversion drive may be used in order to reduce the shadowing. The N-line inversion drive has a difference (such as deficiency and excess of the writing) between the writing during the same polarity and the writing during the inversion of the polarity at inversion position I where the phase of the polarity of the data voltage is inversed, which results in a problem in that the horizontal streak is generated.

In order to improve the above problem, the liquid crystal display device of the third exemplary embodiment has image display region 21 configured by arranging the plurality of pixels P in a matrix form. The liquid crystal display device includes the plurality of gate signal lines GL respectively disposed for each pixel row 22 in image display region 21, the plurality of gate signal lines GL being used to select pixel row 22 in which the data voltage corresponding to the image data is written, gate driver 25 that supplies the gate signal to the plurality of gate signal lines GL, the plurality of data signal lines SL respectively disposed for each pixel column 23 in image display region 21, the plurality of data signal lines SL being used to write the data voltage in pixel P of selected pixel row 22, source driver 24 that supplies the data voltage to the plurality of data signal lines SL, and controller 30*c* that controls gate driver 25 and source driver 24. Controller 30*c* includes phase inversion controller 37 that inverts the phase of the polarity of the data voltage in units of m (m is an integer of 1 or more) pixel rows, and shifts at least one inversion position I (an example of the position of pixel row 22) where the phase of the polarity of the data voltage is inverted by a predetermined pixel row for each frame.

Because controller 30*c* includes phase inversion controller 37, as described in the second modification of the first exemplary embodiment, inversion position I where the polarity of the data voltage is inverted is shifted in the N-line inversion drive, so that the horizontal streak can be prevented from being visually recognized at inversion position I, and the image quality can be improved.

Phase inversion controller 37 prevents the horizontal steak from being visually recognized, so that the number of pixel rows (N lines) constituting the pixel row group that is a collection of the pixel rows to which the data voltage having the same polarity is supplied can be increased. In other words, the number of inversion positions I where the polarity of the data voltage is inverted can be decreased. Consequently, the effect that reduces the power consumption is obtained.

Thus, liquid crystal display device 10*c* can reduce the power consumed in the liquid crystal panel while preventing the generation of the image quality degradation.

As described above, the display method of liquid crystal display device 10*c* of the third exemplary embodiment is a display method of liquid crystal display device 10*c* configured by arranging the plurality of pixels P in a matrix form, the phase of the polarity of the data voltage is inverted in units of m (m is an integer of 1 or more) pixel rows, and the position of the pixel row (for example, inversion position I) where the phase of the polarity of the data voltage is inverted is shifted by each predetermined pixel row for each frame.

Other Exemplary Embodiments

The liquid crystal display device and the display method of the liquid crystal display device of the present disclosure are described above based on the exemplary embodiments, but the present disclosure is not limited to the exemplary embodiments.

Thus, the components described in the attached drawings and the detailed description include not only the components necessary for the solution of the problem but also the components not necessary for the solution of the problem in order to exemplify the technique. For this reason, it should not be immediately recognized that the unnecessary components are necessary as those unnecessary components are described in the accompanying drawings and detailed description.

For example, the low-power driving such as the thinning-out drive is performed in the liquid crystal display device of the exemplary embodiment. Alternatively, the low-power drive and normal drive may be switched. In the normal drive, the supply of the gate signal to the plurality of gate signal lines is completed from top to bottom by the source driver and the gate driver (that is, the plurality of gate signal lines are scanned in the arrangement order), thereby writing the data voltage corresponding to the image data in all the pixels once. In the normal drive, the image of one frame is generated by writing the image data for all the pixels.

In the embodiments, by way of example, the liquid crystal display device includes the liquid crystal panel as the display panel. However, the present disclosure is not limited to the embodiments. For example, the present disclosure can be applied to an image display device including an organic EL panel as the display panel.

In the embodiments, by way of example, the liquid crystal display device includes one liquid crystal panel. However, the present disclosure is not limited to the embodiments. The liquid crystal display device may be a display device in which a plurality of liquid crystal panels are superimposed on each other to display one image using the plurality of liquid crystal panels.

In the exemplary embodiment, by way of example, the determination unit makes the correlation determination using the image data in which the predetermined image processing is performed on the input image signal. However, the present disclosure is not limited to the exemplary embodiment. For example, the determination unit may determine the correlation based on the input image signal before the predetermined image processing is performed.

In the exemplary embodiment, by way of example, the controller controls the source driver by the column inversion drive or the row line inversion drive to display the image. However, the driving method is not limited to the exemplary embodiment. The controller may display the image by controlling the source driver by the dot inversion drive in which the polarity of the data voltage between adjacent pixels is inverted while performing the frame inversion drive in the thinning-out drive, or the controller may control the source driver by another driving method to display the image.

Each of components such as the image input unit, the determination unit, the drive line switching unit, the source drive controller, the gate drive controller, the phase inversion controller, and the memory controller of the controller may be constructed with dedicated hardware or implemented by executing a software program suitable for each component. In this case, for example, each component may include an arithmetic processor (not illustrated) and a storage (not illustrated) that stores a control program. Examples of the arithmetic processing unit include an MPU (Micro Processing Unit) and a CPU (Central Processing Unit). A memory such as a semiconductor memory is exemplified as the storage. Each component may be constructed with a single element that performs centralized control, or a plurality of elements that perform distributed control in cooperation with each other. The software program may be provided as an application through communication via a communication network such as the Internet or communication according to a mobile communication standard.

Each component may be a circuit such as an LSI (Large Scale Integration) and a system LSI. A plurality of components may constitute one circuit as a whole, or constitute separate circuits. The circuit may be a general-purpose circuit or a dedicated circuit.

The system LSI is an ultra-multifunctional LSI manufactured by integrating a plurality of components on a single chip. Specifically, the system LSI is a computer system including a microprocessor, a ROM (Read Only Memory), and a RAM (Random Access Memory). A computer program is stored in the RAM. The microprocessor operates according to the computer program, whereby the system LSI achieves its functions. The system LSI and the LSI may be an FPGA (Field Programmable Gate Array) that can be programmed after manufacturing the LSI, and may include a reconfigurable processor that can reconfigure connection and setting of circuit cells in the LSI.

Some or all of the above components may be constructed with a removable IC (Integrated Circuit) card or a single module. The IC card or the module is a computer system including the microprocessor, the ROM, and the RAM. The IC card or the module may include the LSI or the system LSI. The microprocessor operates according to the computer program, whereby the IC card or the module achieves its functions. The IC card and the module may have a tamper-resistant property.

Division of the functional blocks in the block diagram is by way of example, and a plurality of functional blocks may be implemented as one functional block, a single functional block may be divided into the plurality of functional blocks, or some functions may be transferred to another functional block. The functions of the plurality of functional blocks having similar functions may be processed in parallel or a time-division manner by single hardware or software.

The order in which the steps in the flowchart are performed is only for illustration in order to specifically describe the present disclosure, and may be order except for the above order. A part of the steps may be performed at the same time (in parallel) as another step.

An embodiment obtained by making various modifications of the exemplary embodiment by to those skilled in the art and an embodiment implemented by arbitrarily combining the components and functions in each exemplary embodiment without departing from the scope of the present disclosure are also included in the present disclosure.

What is claimed is:

1. An image display device with a display region configured by arranging a plurality of pixels in a matrix form, comprising:

a plurality of gate signal lines respectively disposed for each pixel row including a first pixel row and a second pixel row different from each other in the display region, and the plurality of gate signal lines being used to select a pixel row in which a data voltage corresponding to image data is written;

a gate driver that supplies a gate signal to the plurality of gate signal lines;

a plurality of data signal lines respectively disposed for each pixel column in the display region, the plurality of data signal lines being used to write the data voltage in pixels of the selected pixel row;

a source driver that supplies the data voltage to the plurality of data signal lines; and a controller that determines whether the second pixel row has correlation with the first pixel row in an image, and controls the gate driver and the source driver based on a determined result, wherein when determining that the second pixel row has the correlation with the first pixel row, the controller causes the source driver to supply the data voltage corresponding to the first pixel row, causes the gate driver to supply the gate signal to write the data voltage corresponding to the first pixel row in the first pixel row, and causes the gate driver to supply the gate signal to write the data voltage corresponding to the first pixel row in the second pixel row.

2. The image display device according to claim 1, wherein the controller controls the gate driver and the source driver to write respective data voltage for every predetermined pixel rows in the plurality of pixel rows in one frame of the plurality of frames, the first pixel row is a pixel row in which the data voltage is written in the one frame, and the second pixel row is a pixel row in which the data voltage is not written in the one frame when the controller determines that the correlation does not exist.

3. The image display device according to claim 2, wherein the controller controls the source driver to perform column inversion drive in which polarities of the data voltage supplied to two adjacent data signal lines are different from each other, a plurality of the first pixel rows exist in the one frame, and the controller determines whether the correlation exists between the first pixel row located in a center in a column direction of the three first pixel rows arranged side by side and each of at least the two second pixel rows disposed between the first pixel row and the rest two first pixel rows except for the first pixel row.

4. The image display device according to claim 2, wherein the controller controls the source driver to perform row line inversion drive in which polarities of the data voltage supplied to the plurality of data signal lines are inverted for every pixel row group constructed with consecutive n (n is an integer of 2 or more) pixel rows, the first pixel rows are respectively disposed for each pixel row group, and the controller determines whether the correlation exists between the first pixel row and each of at least the one second pixel row included in the pixel row group in which the first pixel row is disposed.

5. The image display device according to claim 2, wherein the gate driver sequentially supplies the gate signal to the plurality of pixel rows in order toward one side in the column direction, and when one second pixel row having the correlation with the first pixel row is located on the other side in the column direction with respect to the first pixel row, the controller further performs control to cause the source driver to supply the data voltage corresponding to the first pixel row, to cause the gate driver to supply the gate signal to write the data voltage corresponding to the first pixel row in the second pixel row located on the other side, and to cause the gate driver to supply the gate signal to write the data voltage corresponding to the first pixel row in the first pixel row.

6. The image display device according to claim 1, further comprising a phase inversion controller that inverts a phase of polarity of the data voltage in units of m (m is an integer of 1 or more) pixel rows, and shifts a position of the pixel row where the phase of the polarity of the data voltage is inverted by every predetermined pixel rows in every predetermined frames.

7. The image display device according to claim 1, further comprising a memory capable of storing image data for one frame, wherein the controller controls the gate driver and the source driver to write respective data voltage in each of a plurality of pixel rows in each of a plurality of frames, when the first pixel row is a predetermined pixel row, the controller controls the gate driver and the source driver to write respective data voltage in each of the plurality of pixel rows in the one frame, and when the first pixel row is not the predetermined pixel row, the controller sets the first pixel row to a first comparison reference line in the one frame, sequentially determines the correlation between the first comparison reference line and at least one second pixel row disposed closer to one side in a column direction than the first comparison reference line, and controls the gate driver and the source driver to write the data voltage corresponding to the first comparison reference line in each second pixel row determined to have the correlation.

8. The image display device according to claim 7, wherein when determining that a head line in the display region has the correlation with the first comparison reference line, the controller controls the gate driver and the source driver to write the data voltage corresponding to the first comparison reference line in the head line, and when determining that the head line in the display region does not have the correlation with the first comparison reference line, the controller sets the head line to the first comparison reference line, and controls the gate driver and the source driver to write the data voltage corresponding to the head line in the head line.

9. The image display device according to claim 8, wherein the controller sequentially determines whether the pixel row including the first pixel row has the correlation with the first comparison reference line for each pixel row, and when the first pixel row becomes the pixel row in which the correlation is determined, the controller stops the determination of the correlation with respect to the first pixel row, and sets the first pixel row to the first comparison reference line again.

10. The image display device according to claim 7, wherein the controller further sets the second pixel row that is initially determined not to have the correlation with the first pixel row in the plurality of second pixel rows to a second comparison reference line, sequentially determines the correlation between the second comparison reference line and at least one third pixel row disposed closer to the one side than the second comparison reference line, and controls the gate driver and the source driver to write the data voltage corresponding to the second comparison reference line in each third pixel row determined to have the correlation.

11. The image display device according to claim 1, wherein the controller determines whether a difference in pixel value between a first pixel and a second pixel disposed in an identical pixel column falls within a predetermined value, the first pixel included in the first pixel row and the second pixel included in the second pixel row, and the controller determines that the second pixel row has the correlation with the first pixel row when the number of second pixels in which the difference in pixel value falls within the predetermined value is greater than or equal to a predetermined number.

12. The image display device according to claim 1, wherein the controller calculates a score according to a difference in pixel value between a first pixel and a second pixel disposed in an identical pixel row, the first pixel included in the first pixel row and the second pixel included in the second pixel row, and the controller determines that the second pixel row has the correlation with the first pixel row when a correlation value indicating a degree of the correlation of the second pixel row with the first pixel row based on the calculated score is greater than or equal to a predetermined number.

13. A display method for image display device including a display region configured by arranging a plurality of pixels in a matrix form, the display method comprising:

determining whether a second pixel row has correlation with a first pixel row in an image; and causing a source driver to supply a data voltage corresponding to the first pixel row, causing gate driver to supply a gate signal to write the data voltage corresponding to the first pixel row in the first pixel row, and causing the gate driver to supply the gate signal to write the data voltage corresponding to the first pixel row in the second pixel row when determining that the second pixel row has the correlation with the first pixel row.

* * * * *